US010934730B2

(12) United States Patent
Goettl et al.

(10) Patent No.: US 10,934,730 B2
(45) Date of Patent: Mar. 2, 2021

(54) IN-FLOOR SWIMMING POOL DRAIN AND SUMP ASSEMBLY

(71) Applicant: Hayward Industries, Inc., Berkeley Heights, NJ (US)

(72) Inventors: John Goettl, Phoenix, AZ (US); Dominic Conn, Tempe, AZ (US); M. Shaun Farrier, Peoria, AZ (US)

(73) Assignee: Hayward Industries, Inc., Berkeley Heights, NJ (US)

( * ) Notice: Subject to any disclaimer, the term of this patent is extended or adjusted under 35 U.S.C. 154(b) by 0 days.

(21) Appl. No.: 16/247,442

(22) Filed: Jan. 14, 2019

(65) Prior Publication Data

US 2019/0218807 A1 Jul. 18, 2019

Related U.S. Application Data

(60) Provisional application No. 62/617,524, filed on Jan. 15, 2018.

(51) Int. Cl.
*E04H 4/12* (2006.01)

(52) U.S. Cl.
CPC ..... *E04H 4/1236* (2013.01)

(58) Field of Classification Search
CPC ..... E04H 4/1236
USPC ..... 4/507
See application file for complete search history.

(56) References Cited

U.S. PATENT DOCUMENTS 680,287 A 8/1901 Steele
902,289 A 10/1908 Gribben et al.
1,255,648 A 2/1918 Sagan
1,605,242 A 11/1926 Keys
1,689,646 A 10/1928 Tutsch
1,797,800 A 3/1931 Sirch
1,937,732 A 12/1933 Tverdak
2,518,205 A 8/1950 Vinokor
(Continued)

FOREIGN PATENT DOCUMENTS

AU 4455599 A 3/2000
AU 146730 S 2/2002
(Continued)

OTHER PUBLICATIONS

International Search Report of the International Searching Authority dated Apr. 25, 2019, issued in connection with International Application No. PCT/US2019/013660 (3 pages).
(Continued)

*Primary Examiner* — Lori L Baker
(74) *Attorney, Agent, or Firm* — McCarter & English, LLP

(57) ABSTRACT

A swimming pool drain and sump assembly with a toroidal drain housing that includes a lower section with a drain outlet port extending through the lower section wall and a continuous annular channel that loops back upon itself, and an upper section supported upon the sump base only along the inner wall, cantilevered over the sump base from a lower edge of the sump cover to an upper edge of the sump cover. The lower section and the upper section form an annular, continuous, uninterrupted, single orifice drain entrance channel between a top edge of the outer wall and the upper edge of the top piece. Some embodiments include a continuous, one-piece blockage tray insert adjustably positioned within the drain entrance channel and an access port cover within an access port that is a continuous opening with the drain entrance channel.

21 Claims, 17 Drawing Sheets

(56) References Cited

U.S. PATENT DOCUMENTS

| | | | |
|---|---|---|---|
| 3,378,858 | A | 4/1968 | Jacuzzi |
| 3,709,435 | A | 1/1973 | Sheets |
| 3,800,486 | A | 4/1974 | Harvey |
| 3,829,910 | A | 8/1974 | Kaufman |
| 3,940,807 | A | 3/1976 | Baker |
| 4,010,901 | A | 3/1977 | Sheets |
| 4,013,374 | A | 3/1977 | Weiler et al. |
| 4,170,047 | A | 10/1979 | Corsette et al. |
| 4,188,674 | A | 2/1980 | Mardirosian |
| D260,170 | S | 8/1981 | Cornwall |
| 4,300,246 | A | 11/1981 | Gould |
| 4,322,860 | A | 4/1982 | Gould |
| 4,429,832 | A | 2/1984 | Sheets |
| 4,462,123 | A | 7/1984 | Morris et al. |
| 4,503,573 | A | 3/1985 | Handzel |
| 4,561,134 | A | 12/1985 | Mathews et al. |
| 4,658,449 | A | 4/1987 | Martin |
| 4,666,333 | A | 5/1987 | Armstrong |
| 4,692,314 | A | 9/1987 | Etani |
| D299,522 | S | 1/1989 | Chalberg |
| 4,815,888 | A | 3/1989 | Stegmeier |
| 4,825,477 | A | 5/1989 | Aranda |
| 4,838,732 | A | 6/1989 | Clark et al. |
| 4,923,946 | A | 5/1990 | Meddaugh |
| 4,957,268 | A | 9/1990 | Picollo et al. |
| 5,003,735 | A | 4/1991 | Bates |
| D319,295 | S | 8/1991 | Ohaus |
| D333,342 | S | 2/1993 | Newhard |
| 5,234,582 | A | 8/1993 | Savoie |
| 5,251,343 | A | 10/1993 | Goettl |
| 5,268,096 | A | 12/1993 | Robol |
| D343,228 | S | 1/1994 | Colin |
| 5,330,811 | A | 7/1994 | Buchalter |
| 5,341,523 | A | 8/1994 | Barnes |
| D351,220 | S | 10/1994 | Barnes |
| 5,360,284 | A | 11/1994 | Allard |
| 5,408,706 | A | 4/1995 | Barnes |
| 5,427,417 | A | 6/1995 | Lechuga |
| 5,458,769 | A | 10/1995 | Johannessen |
| 5,689,928 | A | 11/1997 | Rasksen |
| 5,724,648 | A | 3/1998 | Shaughnessy et al. |
| 5,729,937 | A | 3/1998 | Mantelli |
| 5,734,999 | A | 4/1998 | Nicholas |
| 5,799,339 | A | 9/1998 | Perry et al. |
| 5,809,587 | A | 9/1998 | Fleischer |
| 5,843,306 | A | 12/1998 | Singleton |
| 5,923,865 | A | 7/1999 | Chilton et al. |
| 5,996,134 | A | 12/1999 | Senninger |
| 6,109,822 | A | 8/2000 | Campbell et al. |
| 6,170,095 | B1 | 1/2001 | Zars |
| 6,209,586 | B1 | 4/2001 | Wright |
| 6,230,337 | B1 | 5/2001 | Barnett |
| 6,314,590 | B1 | 11/2001 | Lee |
| 6,340,035 | B2 | 1/2002 | Wright |
| 6,397,408 | B1 | 6/2002 | Veloskey et al. |
| 6,419,840 | B1 | 7/2002 | Meincke |
| 6,557,588 | B2 | 5/2003 | Wright |
| 6,595,243 | B2 | 7/2003 | Tarr |
| 6,810,537 | B1 | 11/2004 | Barnes et al. |
| 7,089,607 | B2 | 8/2006 | Barnes et al. |
| 7,178,179 | B2 | 2/2007 | Barnes |
| 7,415,802 | B2 | 8/2008 | Froeter |
| D613,829 | S | 4/2010 | Griffin |
| 7,739,757 | B2 | 6/2010 | Witt |
| D621,009 | S | 8/2010 | Mjelde |
| 7,774,870 | B2 | 8/2010 | Griffin |
| D623,727 | S | 9/2010 | Mjelde |
| D623,728 | S | 9/2010 | Mjelde |
| 7,788,743 | B2 | 9/2010 | Mjelde |
| 7,862,729 | B2 | 1/2011 | Stetson |
| 7,992,236 | B2 | 8/2011 | DeGooyer |
| 7,996,931 | B2 | 8/2011 | Plette |
| D663,387 | S | 7/2012 | Mjelde |
| D663,388 | S | 7/2012 | Mjelde |
| 8,272,078 | B2 | 9/2012 | Snow et al. |
| 8,281,427 | B2 | 10/2012 | Afshar |
| 8,557,109 | B1 | 10/2013 | Sutherland |
| 8,627,519 | B2 | 1/2014 | Jacobs |
| D700,299 | S | 2/2014 | Mjelde |
| 8,650,673 | B1 | 2/2014 | Goettl |
| D701,293 | S | 3/2014 | Mjelde |
| 8,713,724 | B1 | 5/2014 | Goettl et al. |
| 9,540,837 | B2 | 1/2017 | Mjelde |
| 9,790,699 | B2 | 10/2017 | Mjelde |
| 9,869,103 | B1 | 1/2018 | Mjelde |
| 10,214,930 | B1 | 2/2019 | Mjelde |
| 10,323,429 | B1 | 6/2019 | Mjelde |
| 10,465,404 | B1 | 11/2019 | Mjelde |
| D873,387 | S | 1/2020 | Vogtner et al. |
| 2001/0013373 | A1 | 8/2001 | Wright |
| 2002/0192028 | A1 | 12/2002 | Carston |
| 2003/0098081 | A1 | 5/2003 | Tarr |
| 2004/0093666 | A1 | 5/2004 | Zars |
| 2005/0150040 | A1 | 7/2005 | Barber |
| 2006/0015996 | A1 | 1/2006 | Goettl |
| 2006/0015997 | A1 | 1/2006 | Barnes |
| 2006/0053544 | A1 | 3/2006 | Hui |
| 2006/0059813 | A1 | 3/2006 | Froeter et al. |
| 2006/0218714 | A1 | 10/2006 | Mjelde et al. |
| 2007/0039095 | A1 | 2/2007 | Lawson |
| 2007/0107119 | A1 | 5/2007 | Plette |
| 2007/0180605 | A1 | 8/2007 | Griffin et al. |
| 2007/0204399 | A1 | 9/2007 | DeGooyer |
| 2007/0266489 | A1 | 11/2007 | Martin |
| 2008/0098506 | A1 | 5/2008 | Mjelde |
| 2008/0148474 | A1 | 6/2008 | Witt |
| 2008/0189926 | A1 | 8/2008 | Luxton |
| 2008/0272038 | A1 | 11/2008 | Stetson |
| 2008/0282466 | A1 | 11/2008 | Swan |
| 2009/0019633 | A1 | 1/2009 | Snow |
| 2009/0320204 | A1 | 12/2009 | Wiseman |
| 2011/0239362 | A1 | 10/2011 | Jacobs |
| 2012/0018362 | A1 | 1/2012 | Swanston |
| 2012/0023658 | A1 | 2/2012 | Bobeck |
| 2012/0036629 | A1 | 2/2012 | Cook |
| 2012/0036630 | A1 | 2/2012 | Cook |
| 2012/0036631 | A1 | 2/2012 | Cook |
| 2012/0036632 | A1 | 2/2012 | Cook |
| 2012/0036697 | A1 | 2/2012 | Cook |
| 2012/0096635 | A1 | 4/2012 | Afshar |
| 2012/0167295 | A1 | 7/2012 | Fima |
| 2012/0297531 | A1 | 11/2012 | Newhard |
| 2013/0061387 | A1 | 3/2013 | Stetson et al. |
| 2014/0157510 | A1 | 6/2014 | Mjelde |

FOREIGN PATENT DOCUMENTS

| | | | |
|---|---|---|---|
| AU | 760860 | B2 | 5/2003 |
| AU | 2005200057 | A1 | 7/2005 |
| AU | 2003226409 | B2 | 8/2007 |
| AU | 2007203106 | B2 | 6/2008 |
| AU | 342136 | S | 4/2012 |
| CN | 202090428 | U | 12/2011 |
| DE | 215355 | A1 | 11/1984 |
| DE | 8600726 | U1 | 3/1987 |
| DE | 202005004087 | U1 | 5/2005 |
| DE | 202011001135 | U1 | 12/2011 |
| DE | 102011018518 | A1 | 9/2012 |
| EP | 0443316 | A1 | 8/1991 |
| EP | 1243709 | A2 | 9/2002 |
| EP | 1705300 | A1 | 9/2006 |
| FR | 2771431 | A1 | 5/1999 |
| GB | 2431101 | A | 4/2007 |
| KR | 940010192 | U | 5/1994 |
| KR | 950005536 | Y1 | 7/1995 |
| KR | 200191082 | Y1 | 8/2000 |
| KR | 20080006173 | U | 12/2008 |
| PH | 2/2004/000116 | U | 11/2006 |
| RU | 147606 | U1 | 11/2014 |

(56) References Cited

FOREIGN PATENT DOCUMENTS

| | | | |
|---|---|---|---|
| WO | 2007/033949 | A1 | 3/2007 |
| WO | 2008/140382 | A1 | 11/2008 |

OTHER PUBLICATIONS

Written Opinion of the International Searching Authority dated Apr. 25, 2019, issued in connection with International Application No. PCT/US2019/013660 (4 pages).
Pleadings Paper from Civil Action No. 5:18-cv-00094-GW-SPx, "Defendant Color Match Pool Fittings, Inc.'s Answer to Third Amended Complaint for Patent Infringement, and Counterclaims," United States District Court for the Central District of California, Eastern Division, Jul. 11, 2019 (31 pages).
Document 179-4 from Civil Action No. 5:18-cv-00094-GW-SPx, Exhibit 4 to "Defendant Color Match Pool Fittings, Inc.'s Answer to Third Amended Complaint for Patent Infringement, and Counterclaims," United States District Court for the Central District of California, Eastern Division, Jul. 11, 2019 (41 pages).
Document 179-12 from Civil Action No. 5:18-cv-00094-GW-SPx, Exhibit 12 to "Defendant Color Match Pool Fittings, Inc.'s Answer to Third Amended Complaint for Patent Infringement, and Counterclaims," United States District Court for the Central District of Califomia, Eastern Division, Jul. 11, 2019 (32 pages).
16 CFR 1450—Virginia Graeme Baker Pool and Spa Safety Act Regulations, Jan. 1, 2011 (1 page).
MDX Debris Removal System Manual, Paramount Pool & Spa Systems, Copyright 2006 (12 pages).
1-1/2 Inch Threaded Wall Fitting with Water Barrier 100/Case, Color Match Pool Fittings, Inc., product shown on archived webpage http://web.archive.org/web/20110208085540/http://poolfittings.com/order.php from Feb 8, 2011 (3 pages).
PDR2 Drain (Powerful Debris Removal) 10" Drain, A&A Manufacturing, archived webpage from Apr. 21, 2011, available at web.archive.org/web/20111211184054/http://aamfg.com:80/pdr2Drain.php (1 page).
PDR2 Drain (Powerful Debris Removal) 10" Drain, A&A Manufacturing, archived webpage from Dec. 11, 2011, available at web.archive.org/web/20111211184054/http://aamfg.com:80/pdr2Drain.php (1 page).
AquaStar Pool Products, AquaStop® Pipe Sleeve with Threaded Slurry Seal Cap and O-Ring (1"/1.5"/2"/2.5"/3"), 2 pages and product sheet excerpted from online product catalog information at https://www.aquastarpoolproducts.com, containing substance of Pipe Sleeve with Threaded Slurry product images and info as published in Aquastar Product catalog, Summer 2010 (3 pages).
AquaStar Pool Products, AquaStop® Pipe Sleeves (1"/1.5"/2"/2.5"/3"), 2 pages and product sheet excerpted from online product catalog information at https://www.aquastarpoolproducts.com, containing substance of Pipe Sleeves product images and info as published in Aquastar Product Catalog, Summer 2010 (3 pages).
U.S. Appl. No. 61/660,566, "Low Profile Circular Drain Covers," filed Jun. 15, 2012 (26 pages).
U.S. Appl. No. 61/734,267, "Channel Drain with Water Stop," filed Dec. 6, 2012 (18 pages).
U.S. Appl. No. 16/439,883, "Low Profile Circular Drain With Water Stop for Swimming Pool," filed Jun. 13, 2019 (41 pages).
Color Match Pool Fittings, Inc., Pebble Top Drain Covers Brochure and Drain Cover Installation Instructions, undated (3 pages).
Color Match Pool Fittings, Inc., Round Pebble Top Drain Covers webpage, http://web.archive.org/web/20151022224121/http://www.poolfittings.com/products/8-inch-vgb-pebble-top-anti-vortex-drain-cover-and-frame/, webpage archived Oct. 22, 2015 (4 of pages).
PDR (Powerful Debris Removal) 10" Drain Brochure, A&A Manufacturing, date unknown, labeled "PDR-0709" (2 pages).
Eclipse Drain Product Brochure, Blue Square MFG, dated Apr. 2015 (6 pages).
Blue Square, Eclipse Drain webpage, https://web.archive.org/web/20130205070828/http://www.bluesquaremfg.com:80/products/eclipse-drain, webpage archived Feb. 5, 2013 (1 page).
Waterco, Eclipse Drain webpage, https://web.archive.org/web/20170312180241/https:/infloorpoolcleaning.com.au/product/eclipse-drain/, webpage archived Mar. 12, 2017 (4 pages).
Eclipse Drain Technical Documents, including "Eclipse Drain Instructions" (date unknown), "20" Eclipse" Technical Drawing (date unknown), "Hydrostatic Valve and Collector Tube, with Blue Square Cover" Technical Drawing (date unknown), "20" Full Circle/Eclipse Sump Installation" Details (date unknown), "Eclipse Drain Install Details" (date unknown), and "Certificate of Compliance" issued Apr. 10, 2013, retrieved from <https://www.bluesquaremfg.com/technical-documents/> on Sep. 30, 2020 (8 pages).
AquaStar Pool Products Inc., 20" Full Circle Suction Outlet Cover and One-Port Manufactured Sump webpage, https://www.aquastarpoolproducts.com/ItemCatalog/20"-Full-Circle-Suction-Outlet-Cover-and-One-Port-Manufactured-Sump, retrieved on Sep. 30, 2020 (2 pages).
AquaStar Pool Products Inc., 20" Full Circle Suction Outlet Cover and One-Port Manufactured Sump, Product Sheet (undated) available as early as Jul. 15, 2013 from <https://web.archive.org/web/20130715024948/http://www.aquastarpoolproducts.com:80/VGB_Round_Outlets.php> (1 page).

IN-FLOOR SWIMMING POOL DRAIN AND SUMP ASSEMBLY

RELATED APPLICATIONS

This application claims the benefit of U.S. provisional patent application 62/617,524, filed Jan. 15, 2018, titled "In-Floor Swimming Pool Drain and Sump Assembly," the entirety of the disclosure of which is incorporated herein by this reference.

TECHNICAL FIELD

Aspects of this document generally relate to an in-floor swimming pool drain and sump assembly, and more particularly to an in-floor swimming pool drain with a toroidal two-piece sump, a continuous, uninterrupted drain entry channel, and an optional drain entry channel blockage tray.

BACKGROUND

Swimming pools and spas (collectively swimming pools herein) include drains to release water from within the swimming pools. For concrete and plaster swimming pool construction, those drains are often constructed at the lowest point in the floor of the swimming pool. The purpose of the drain is to provide an outlet for flow of water from the swimming pool to the suction side of a pump. The outflow of the pump is passed through a filter to remove entrained matter. The filtered water is returned to the swimming pool at above and/or below water levels in the pool. Usually, the suction line from the drain includes a debris trap upstream of the pump to collect large sized debris. U.S. Pat. No. 8,713,724, the disclosure of which is hereby incorporated herein by reference, includes an explanation of the structure and purpose of a conventional drain system.

SUMMARY

According to an aspect, a swimming pool drain and sump assembly for an in-floor swimming pool drain may comprise a two-piece toroidal drain housing with a lower section forming a sump base having an annular outer wall, an annular inner wall, and an annular bottom wall joining the inner wall and the outer wall along bottoms of each of the inner wall and the outer wall, the lower section wall comprising at least one drain outlet port extending through the lower section wall, the lower section forming a continuous annular channel that loops back upon itself, an upper section forming a sump cover supported upon the sump base only along the inner wall, the sump cover extending in a cantilevered fashion over the sump base from a lower edge of the sump cover to an upper edge of the sump cover, the sump cover engaging the inner wall of the sump base, wherein the lower section and the upper section forming an annular, continuous, uninterrupted, single orifice drain entrance channel between a top edge of the outer wall and the upper edge of the top piece, a continuous, one-piece blockage tray insert adjustably positioned within the drain entrance channel and configured to allow an angle of the blockage tray insert to be adjusted separate from the top edge of the outer wall of the sump base, the blockage tray insert comprising an outer edge flange extending outward of the top edge of the outer wall of the sump base, and an inner edge flange extending inward of the upper edge of the sump cover, the blockage tray insert comprising an outer edge wall extending into the drain entrance channel from the outer edge flange and an inner edge wall extending into the drain entrance channel from the inner edge flange, and at least one blockage wall extends between the outer edge wall and the inner edge wall, the at least one blockage wall oriented such that a length of the blockage wall extending along an annular length within the drain entrance channel is longer than its width extending from the outer edge wall to the inner edge wall, and at least one access port cover positioned between the top edge of the outer wall and the upper edge of the sump cover, the at least one access port cover positioned directly above the at least one drain outlet port within at least one access port that is a continuous opening with the annular, continuous, uninterrupted, single orifice drain entrance channel.

Particular embodiments may comprise one or more of the following features. The bottom piece may comprise a cross-sectional shape having an outwardly extending, rounded bottom wall with an inwardly extending first step in the bottom wall between the bottom wall and the outer wall, and an inwardly extending second step between the bottom wall and the inner wall. Structural support fins may be formed as part of the top piece between the upper edge and the lower edge of the sump cover. The blockage tray insert may further comprise an opening sized to receive the at least one access port cover between the outer edge flange and the inner edge flange, wherein a wall of the at least one access port cover forms a portion of a side wall of the annular, continuous, uninterrupted, single orifice drain entrance channel. The at least one drain outlet port extending through the bottom wall may comprise two drain outlet ports extending through the bottom wall, the two drain outlet ports positioned annularly opposite each other on the annular bottom wall. A hydrostatic safety port may be coupled to the bottom wall, the hydrostatic safety port coupled to the bottom wall through an opening positioned annularly opposite the at least one drain outlet port extending through the bottom wall. The at least one drain outlet port may extend through the bottom wall comprises two drain outlet ports extending through the bottom wall, the two drain outlet ports positioned annularly opposite each other on the annular bottom wall, wherein the hydrostatic safety port is coupled to the bottom wall at a bottom of a drain pipe coupled to one of the two drain outlet ports. A hydrostatic port bellows may surround the hydrostatic safety port and extending between the hydrostatic safety port and a first of the at least one access port covers, the hydrostatic port bellows isolating the hydrostatic safety port from drain suction pressure within the sump assembly. A center area of the drain and sump assembly may be open providing a continuous, unimpeded passageway through the toroidal center of the two-piece toroidal drain housing. The top piece may further comprise a water stop extending away from the bottom piece between the lower edge of the sump cover and the upper edge of the sump cover.

According to an aspect, a swimming pool drain and sump assembly for an in-floor swimming pool drain may comprise a toroidal drain housing with a bottom piece forming a sump base having an annular outer wall, an annular inner wall, and an annular bottom wall joining the inner wall and the outer wall along bottoms of each of the inner wall and the outer wall, the bottom wall comprising at least one drain outlet port extending through the bottom wall, the bottom piece forming an annular channel that loops back upon itself, and a top piece forming a sump cover with a lower edge engaging the inner wall of the sump base, the sump cover supported upon and extending over the sump base, wherein the bottom piece and the top piece forming a continuous, annular, single orifice drain entrance channel between a top edge of the outer wall and the upper edge of the top piece.

Particular embodiments may comprise one or more of the following features. A blockage tray insert may be positioned within the drain entrance channel, the blockage tray insert comprising an outer edge flange extending outward of the top edge of the outer wall of the sump base, an inner edge flange extending inward of the upper edge of the sump cover, an outer edge wall extending into the drain entrance channel from the outer edge flange, and an inner edge wall extending into the drain entrance channel from the inner edge flange. The blockage tray insert may comprise at least one blockage wall that extends between the outer edge wall and the inner edge wall that is oriented such that a length of the blockage wall extending along an annular length within the drain entrance channel is longer than its width extending from the outer edge wall to the inner edge wall. At least one access port cover may be positioned between the top edge of the outer wall and the upper edge of the sump cover, the at least one access port cover positioned directly above the at least one drain outlet port, wherein the at least one access port cover is positioned within at least one access port that is a continuous opening with the annular, continuous, single orifice drain entrance channel and a wall of the at least one access port cover forms a portion of a side wall of the continuous, annular, single orifice drain entrance channel. The at least one drain outlet port extending through the bottom wall may comprise two drain outlet ports extending through the bottom wall, the two drain outlet ports positioned opposite each other on the annular bottom wall. A hydrostatic safety port may be coupled to the bottom wall through an opening positioned annularly opposite the at least one drain outlet port extending through the bottom wall.

According to an aspect, a swimming pool drain and sump assembly for an in-floor swimming pool drain may comprise a bottom piece forming a sump base having an outer wall, an inner wall, and an annular bottom wall joining the inner wall and the outer wall, the bottom wall comprising at least one drain outlet port extending through the bottom wall, the bottom piece forming a channel, and a top piece forming a sump cover with a lower edge engaging the inner wall of the sump base, the sump cover supported upon and extending over the sump base, wherein the bottom piece and the top piece form a continuous, annular, single orifice drain entrance channel between a top edge of the outer wall and an upper edge of the top piece.

Particular embodiments may comprise one or more of the following features. At least one access port cover may be positioned between the top edge of the outer wall and the upper edge of the sump cover, the at least one access port cover positioned in at least one access port above the at least one drain outlet port, wherein the within at least one access port that is a continuous opening with the annular, continuous, uninterrupted, single orifice drain entrance channel. A blockage tray insert positioned within the drain entrance channel, the blockage tray insert comprising an outer edge flange extending outward of the top edge of the outer wall of the sump base, an inner edge flange extending inward of the upper edge of the sump cover, an outer edge wall extending into the drain entrance channel from the outer edge flange, and an inner edge wall extending into the drain entrance channel from the inner edge flange. A hydrostatic safety port may be coupled to the bottom wall through an opening positioned annularly opposite the at least one drain outlet port extending through the bottom wall. The at least one drain outlet port may extend through the bottom wall and comprise two drain outlet ports extending through the bottom wall, the two drain outlet ports positioned annularly opposite each other on the annular bottom wall, wherein the hydrostatic safety port is coupled to the bottom wall at a bottom of a drain pipe coupled to one of the two drain outlet ports.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain, and ordinary meaning to the terms be applied to the interpretation of the specification and claims.

The inventors are also aware of the normal precepts of English grammar. Thus, if a noun, term, or phrase is intended to be further characterized, specified, or narrowed in some way, such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112, ¶6. Thus, the use of the words "function," "means" or "step" in the Detailed Description or Description of the Drawings or claims is not intended to somehow indicate a desire to invoke the special provisions of 35 U.S.C. § 112, ¶6, to define the invention. To the contrary, if the provisions of 35 U.S.C. § 112, ¶6 are sought to be invoked to define the inventions, the claims will specifically and expressly state the exact phrases "means for" or "step for", and will also recite the word "function" (i.e., will state "means for performing the function of [insert function]"), without also reciting in such phrases any structure, material, or acts in support of the function. Thus, even when the claims recite a "means for performing the function of . . . " or "step for performing the function of . . . ," if the claims also recite any structure, material, or acts in support of that means or step, or to perform the recited function, it is the clear intention of the inventors not to invoke the provisions of 35 U.S.C. § 112, ¶6. Moreover, even if the provisions of 35 U.S.C. § 112, ¶6, are invoked to define the claimed aspects, it is intended that these aspects not be limited only to the specific structure, material, or acts that are described in the preferred embodiments, but in addition, include any and all structures, material, or acts that perform the claimed function as described in alternative embodiments or forms in the disclosure, or that are well-known present or later-developed, equivalent structures, material, or acts for performing the claimed function.

The foregoing and other aspects, features, and advantages will be apparent to those artisans of ordinary skill in the art from the DETAILED DESCRIPTION and DRAWINGS, and from the CLAIMS.

BRIEF DESCRIPTION OF THE DRAWINGS

The present disclosure will now be described by way of example, with reference to the accompanying drawings.

Figure 1:
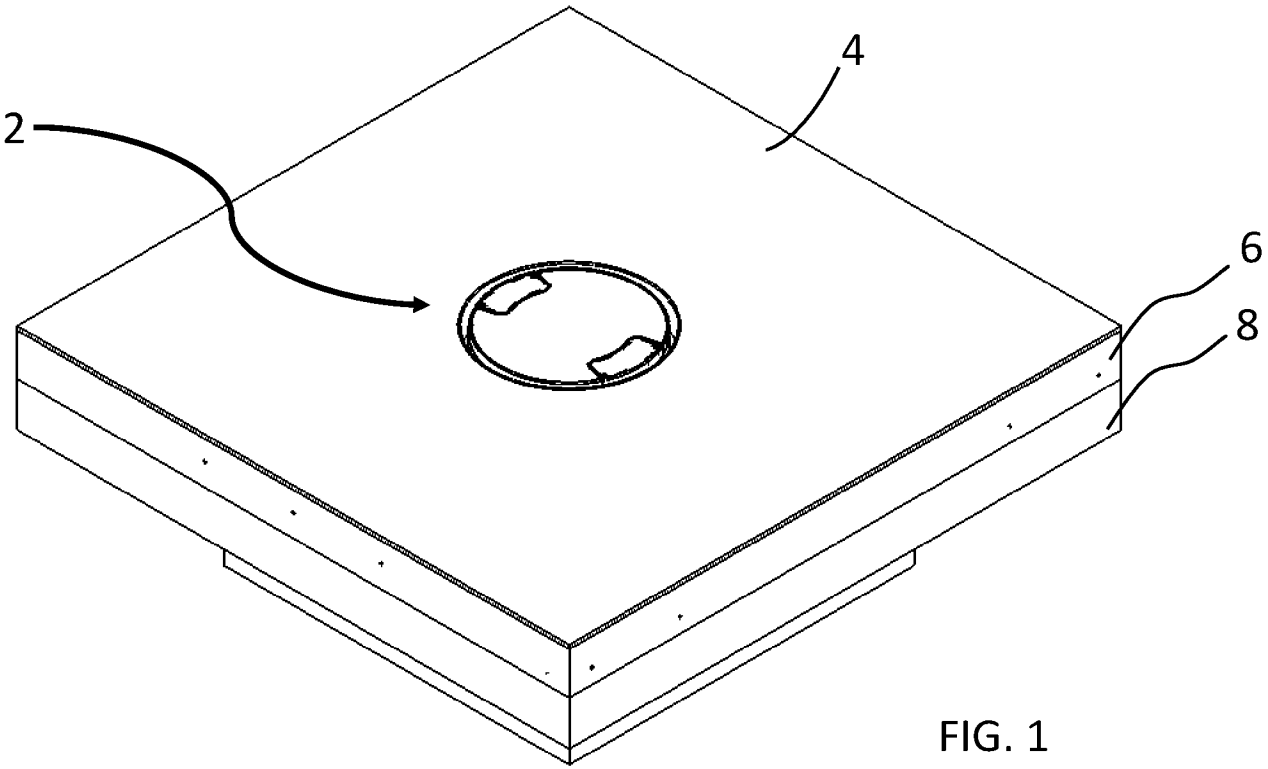
FIG. 1 is a perspective view of a swimming pool drain and sump assembly installed in a swimming pool floor.

While the present disclosure will be described in connection with the embodiments shown herein, it will be understood that it is not intended to limit the disclosure to those embodiments. On the contrary, it is intended to cover all alternatives, modifications, and equivalents, as may be included within the spirit and scope of the disclosure as defined by the appended claims.

DETAILED DESCRIPTION

This disclosure, its aspects and implementations, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The words "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes embodiments in many different forms, there is shown in the drawings and will herein be described in detail embodiments of the disclosure with the understanding that the present disclosure is to be considered as an exemplification of the principles of the disclosure and is not intended to limit the broad aspect of the disclosure to the embodiments illustrated.

This disclosure is particularly advantageous for swimming pool drain and sump assemblies 2 (see FIG. 1) that are built into the floor of a concrete 6 and plaster and/or aggregate 4 type swimming pool, typically built on dirt 8, but features of the swimming pool drain and sump assemblies 2 disclosed herein may alternatively be used in any other swimming pool type as well including vinyl and fiberglass. Those of ordinary skill in the art will understand how to adapt the pool drain and sump assemblies and their various features to other drain types from the examples used in concrete and plaster or aggregate in this disclosure.

Two specific embodiment examples of in-floor drain assemblies are described herein that differ from each other only in that one has two drain exit ports to couple with one or more pump lines, and the other has only one drain outlet port to couple with one or more pump lines. However, because the absence of one of the drain outlet ports in one of the embodiment examples provides an additional location to position a hydrostatic safety port, a separate set of drawings is included for each example. Unless a particular feature is specifically identified as being associated with only a single embodiment and not possible with other embodiments, it is intended that the description provided herein apply to all embodiments of in-floor drain assemblies.

FIGS. 2A-2F and 3A-3E illustrate various views of in-floor swimming pool drain and sump assemblies 2, 3, having a two-piece toroidal drain housing 10, 11, with a top piece 14 and a bottom piece 12, 13. The bottom piece forms a sump base 12, 13 having an annular outer wall 16, an annular inner wall 18, and an annular bottom wall 20 joining the inner wall 18 and the outer wall 16 along the bottoms 22, 24 of each of the inner wall 18 and the outer wall 16. In particular embodiments, the outer wall 16 comprises an outer wall flange 17 extending outward of the wall. The bottom wall 20 includes at least one drain outlet port 26, 28 extending through the bottom wall. In particular embodiments, the sump base 12, 13 forms an uninterrupted, continuous, annular sump channel 30 that loops back upon itself. The entrance channel 38 matches the continuous sump channel 30 except that in some embodiments the blockage tray insert 40 or restriction in the opening may be used to regulate the rate and direction of water flow through the entrance. In debris-receiving drains it is advantageous to have an area of the continuous or interrupted entrance channel 38 to operate at a higher velocity in that opening to attract and catch debris. The rest of the entrance channel 38 that is blocked by a blockage tray insert 40 will have a lower velocity in the portions that are blocked by the blockage tray insert 40 or in areas that are blocked by debris or a body. Embodiments where a continuous entrance channel 38 is used that wraps back around to itself have the added benefit over a straight or curved entrance channel that does not wrap back on itself or an entrance channel that is not continuous in that with a continuous entrance channel 38 the flow can equalize in both directions. However, straight or curved entrance channels that do not wrap back on themselves but include a sump of the shapes disclosed herein (FIGS. 4A-4F) are considered viable and advantageous.

Conventionally, in-floor drains are manufactured with two or more glue joints at the inner diameter and outer diameter minimally to make the inlet and outlet sump manufacturable. The embodiments shown and described in this disclosure are advantageous for manufacturing because they may be built with only one glue joint on the inner diameter between the inlet and the sump. In one particular conventional drain approach, there are additional channels from the sump to a central exit point. These additional channels extending off of the sump complicate the assembly, add many glue points and make the drain more susceptible to plugging. In another conventional approach, the drain has a large cover that forms a passage to the center of the drain that is heavy and prone to cracking due to the aggregate filling surrounding the drain.

Although other configurations are contemplated and those of ordinary skill in the art will readily be able to determine how best to couple the sump and drain assemblies 2, 3 to the plumbing for a particular pump or pumps, the drain outlet ports 26, 28, as shown, are coupled to vertically descending portions 72, horizontally extending portions 74, and narrowing portions 76. By including an enlarged drain passage extending a distance from the entrance to the sump and drain assembly 2, 3, items, such as clothing or hair, attached to a swimmer may experience lower velocities and lower forces drawing them toward the pump for the first distance into the drain until the items reach the narrowing portions 76 and the rest of the swimming pool pump plumbing. This may relieve some of the force that could ordinarily trap a swimmer to the bottom of the swimming pool if the item attached to the swimmer was drawn into the drain. Particular embodiments of the drain outlet ports may be adapted to receive a thread protector 82, or a drain seal plug 81 (see FIGS. 2F, 3E) such as through an internally threaded portion 70 (see FIGS. 2D and 3C) of the drain port 26, 28 or the vertically descending portion 72 (that attaches to the drain port 26, 28.

Figure 2A:
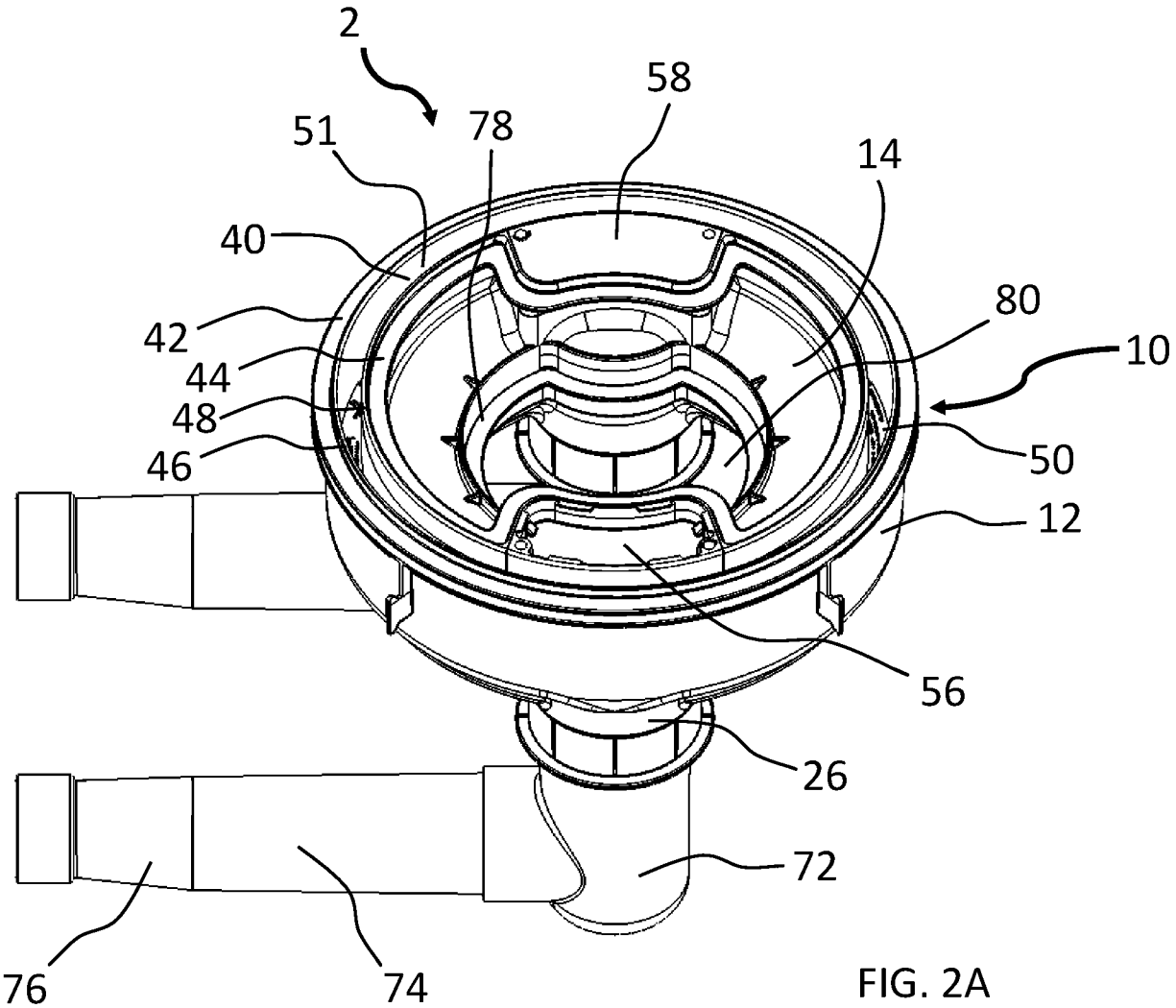
FIG. 2A is a perspective view of a swimming pool drain and sump assembly with two drain pipes.

The thread protectors 82 may be used to keep glue, concrete and other debris from damaging the seal or threads of the sump as well as from keeping the drain seal plug 81 from being permanently bonded to the sump during the construction process. FIG. 2G illustrates a view, like that of FIG. 2D, of a particular embodiment showing thread protectors 82 installed into the internally threaded portions 70 of the drain port vertically descending portions 72. In particular embodiments, the thread protectors 82 are formed of a plastic material, such as polypropylene, that the conventional plumbing adhesives, such as solvent cement, doesn't adhere to. Use of this type of plastic material allows the external threads of the thread protectors 82 to wipe away any adhesive that may have gotten into the threads and prevent additional adhesive from entering the threads of the internal threaded portions 70 so that the threads are clean for use by a drain seal plug 81 (FIGS. 2F, 3E). The threaded protectors 82 may be used in any of the embodiments disclosed herein.

The enlarged downward drain outlet area and access port 59 with a removable access port cover 56, 58 further allows one to service the enlarged downward drain outlet or install the drain seal plugs 82 (FIG. 2F, 3E) in the drain outlet for testing or winterizing of the drain. This provides an easily sealable point with standard seal plugs. Because the sealable point is disposed in the sump area that is enlarged, accessible and easily visible, it is easier for the installer or service tech to test or winterize the fitting and isolate the plumbing. Other conventional versions of in-floor pool drains have limited access covers with little access or large top covers that must be removed to access the plugs. By using a portion of the entrance channel opening to enlarge the access port 59, the size of the access cover can be minimized while providing a larger access area. In this way, the access port 59 is a continuous opening with the entrance channel 38. In particular embodiments, the access port cover 56, 58 disposed over the downward exit may be filled with pool final finish aggregate (see FIG. 1) or it may be other solid material, such as plastic, and not be intended to be filled with aggregate.

The drain outlet port 26, 28 in particular embodiments, including the ones described above, are coupled to the sump base 12, 13 by a round coupling to allow the drain outlet port 26, 28 to be fixed or rotated and then fixed in the direction of the existing pool plumbing. This simplifies an installer's work which typically involves adapting the drain connection from the drain housing with multiple connectors to point in the direction of the pool pump plumbing. By using a round connector for the drain outlet port 26, 28 that faces downward from the drain housing, a simple vertically descending pipe 72 may be coupled to it and rotated anywhere within a full 360 degrees to the desired direction.

The top piece of the two-piece drain housing 10, 11 forms a sump cover 14 supported on the sump base 12, 13 only along the inner wall 18 of the sump base 12, 13. The sump cover 14 extends outward from the inner wall 18 of the sump base 12, 13 over the sump base 12, 13 in a cantilevered fashion from the lower edge 32 of the sump cover 14 to the upper edge 34 of the sump cover. This cantilevered extension of the sump cover 14 over the sump base adds to the uninterrupted, continuous nature of the channel 30 in the sump base 12, 13 by not requiring any supports for the sump cover 14 that would interrupt the channel 30 (see FIGS. 2C, 2F and 3E for the uninterrupted channel 30). Additionally, by cantilevering the sump cover 14 over the sump base 12, 13, there are no structural supports within the drain opening so that it forms an annular, continuous, uninterrupted, single orifice drain entrance channel 38 between the top edge 36 of the outer wall 16 and the upper edge 34 of the sump cover 14. As is illustrated in the associated Figures, the drain entrance channel 38 extends all the way around the opening to the drain and has only a single orifice. Inclusion of only a single orifice to the drain opening reduces opportunity for hair and other items to become entwined with the drain. In particular embodiments, the sump base 12, 13 and cover 14 together form a toroidal drain housing 2, 3.

Although it is not required for use in all embodiments or installations, an installer may use a blockage tray insert 40 that blocks specific parts of the drain entrance channel 38 or a specific amount of the drain entrance channel 38 depending upon the particular drain water flow needs of the swimming pool into which the drain is installed, considering the size of the pool, the strength of the pump, and the amount of debris expected for that swimming pool. An optional continuous, one-piece blockage tray insert 40 formed as a continuous ring or otherwise may be positioned within the drain entrance channel 38 to restrict or direct water flow into the drain entrance channel 38. In a particular embodiment, the blockage tray insert 40 has an outer edge flange 42 extending outward of the top edge 36 of the outer wall 16 of the sump base 12, 13 and an inner edge flange 44 extending inward of the upper edge 34 of the sump cover 14. The blockage tray insert also includes an outer edge wall 46 extending into the drain entrance channel 38 from the outer edge flange 42 and an inner edge wall 48 extending into the drain entrance channel 38 from the inner edge flange 44. The outer edge wall 46 and the inner edge wall 48 form a blockage tray insert channel 51. At least one blockage wall 50 extends between the outer edge wall 46 and the inner edge wall 48 to join the outer edge wall 46 to the inner edge wall 48 and to provide a positionable blockage for the drain to restrict or direct water entrance into the drain 2, 3. Each of the at least one blockage wall 50 is oriented such that a length 52 of the blockage wall extends along an annular length within the drain entrance channel 38. The annular length 52 within the drain entrance channel 38 is longer than the width 54 (FIG. 2E) of the blockage wall 50 extending from the outer edge wall 46 to the inner edge wall 48. In a particular embodiment, not shown, the blockage tray insert may be configured as a grate with contiguous openings separated by dividers around the continuous ring of the blockage tray insert.

Figure 2B:
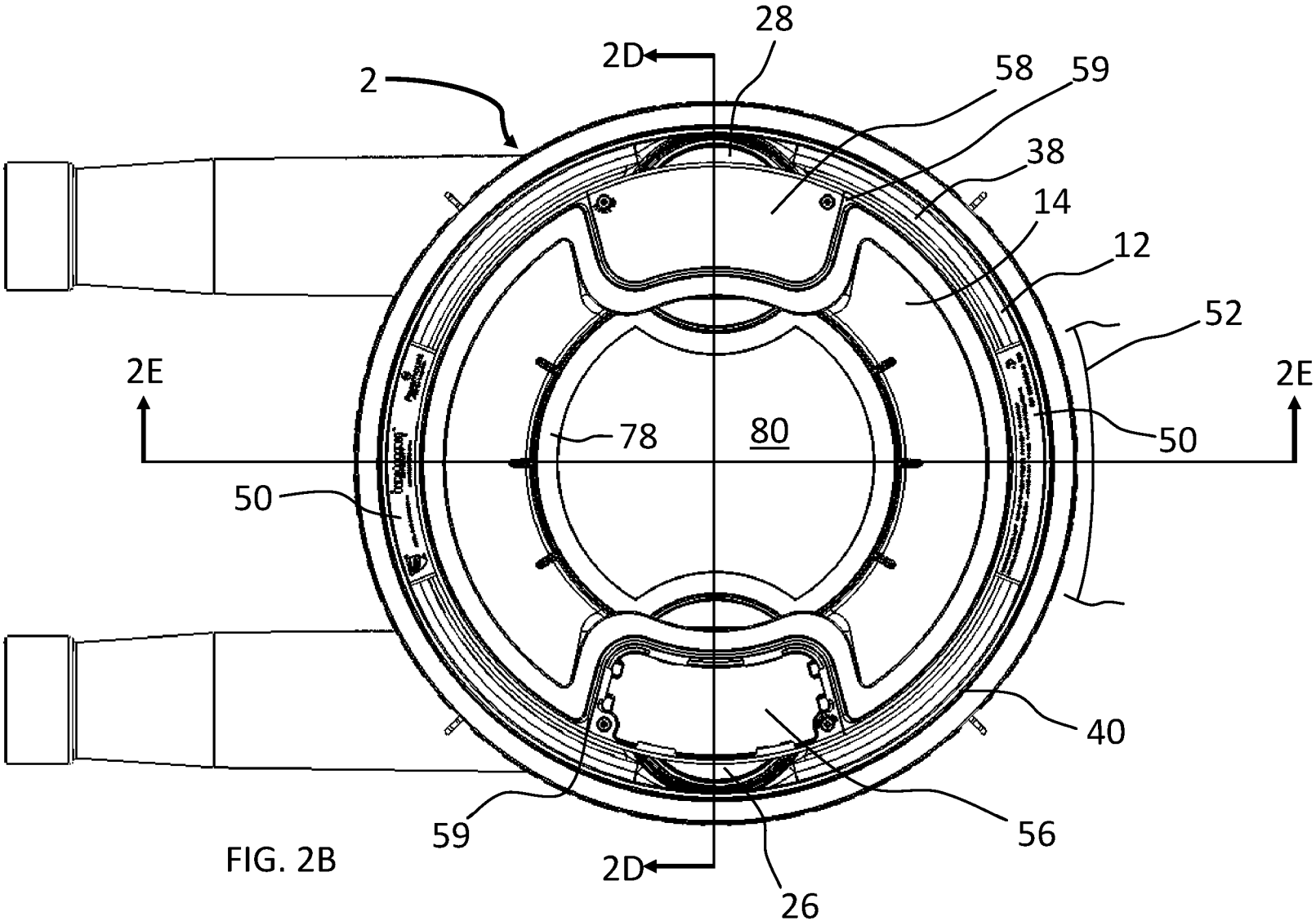
FIG. 2B is a top view of the swimming pool drain and sump assembly of FIG. 2A.
Figure 2C:
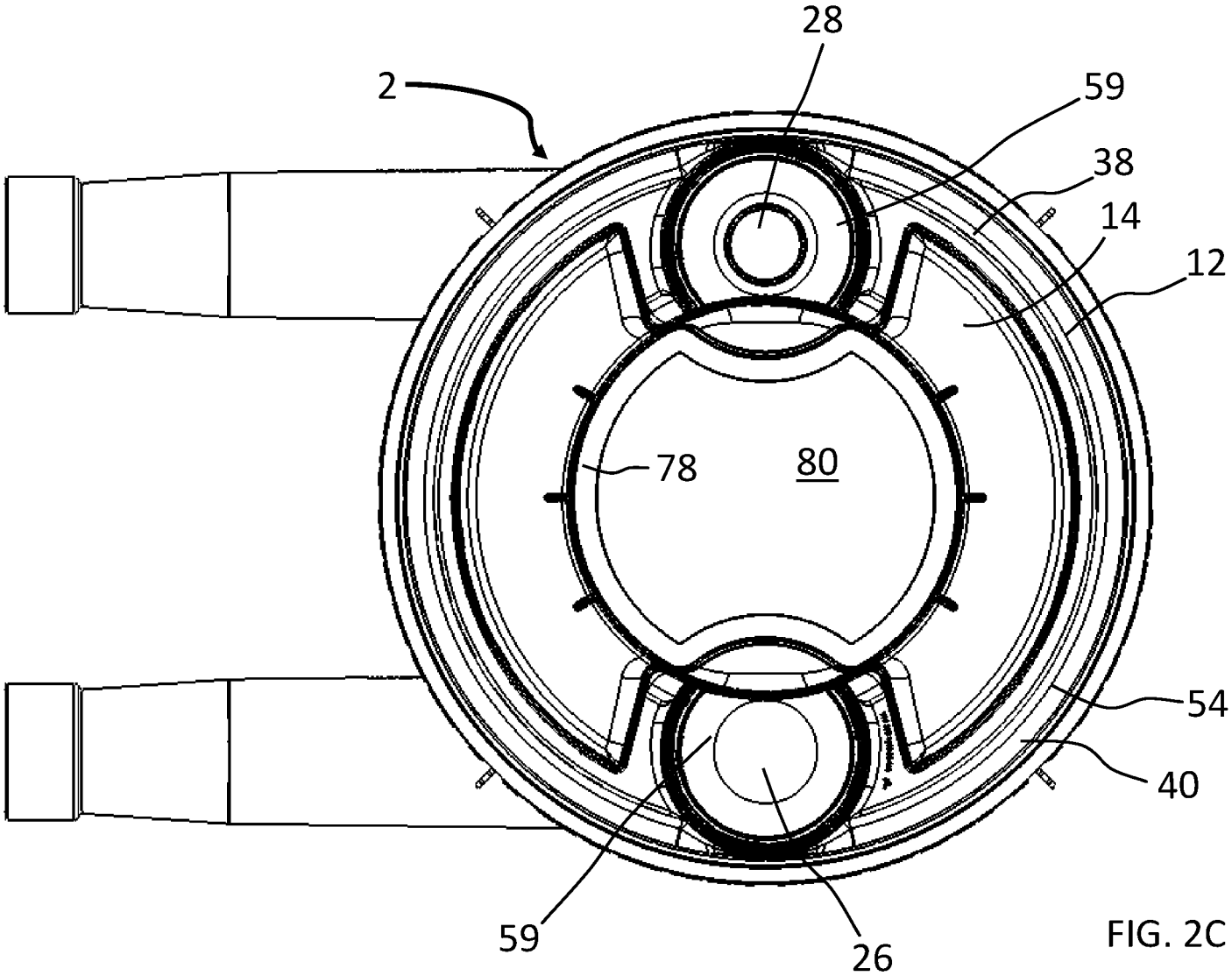
FIG. 2C is a top view of the swimming pool drain and sump assembly of FIG. 2A with the blockage insert removed.
Figure 2D:
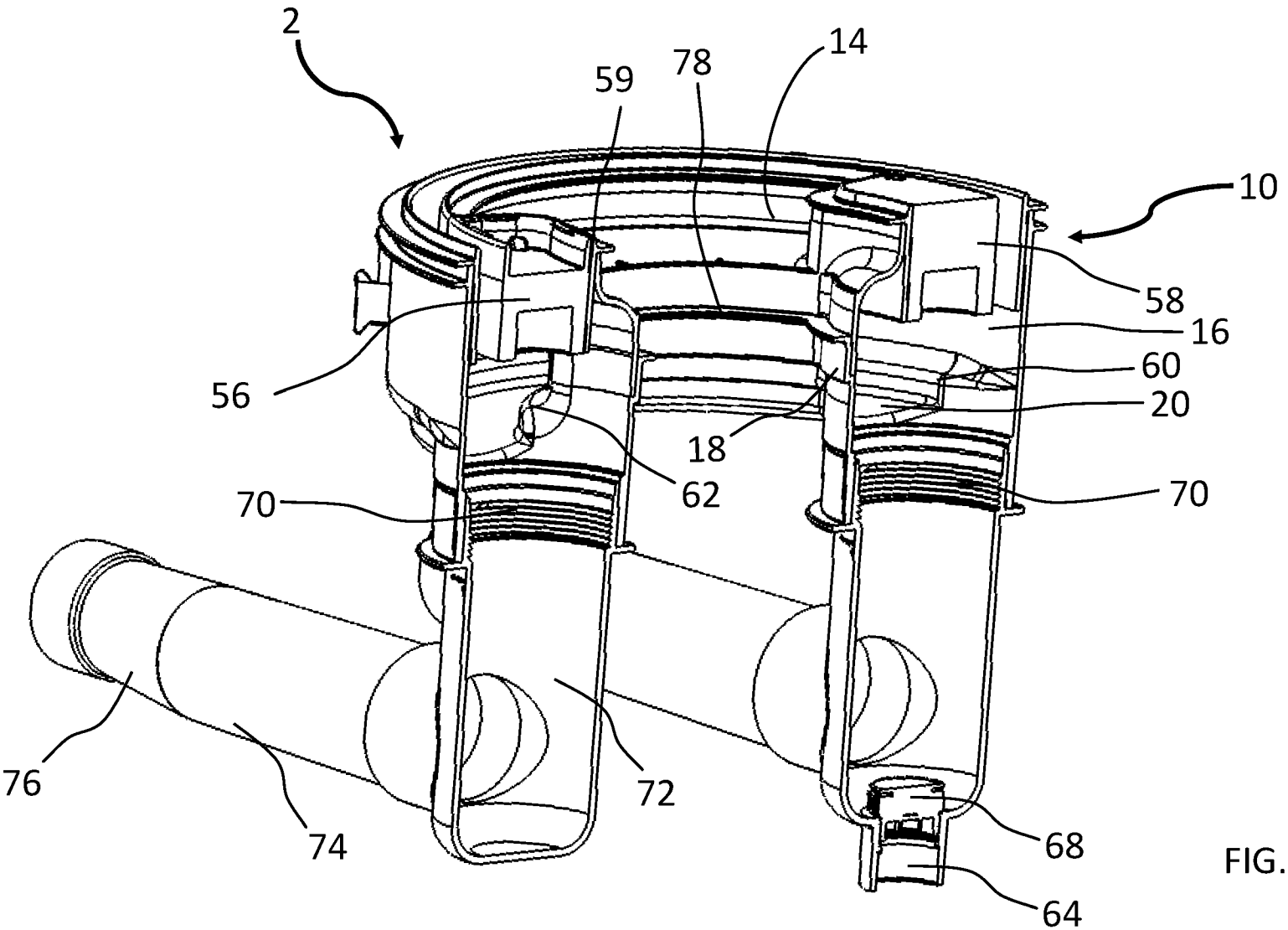
FIG. 2D is a cross-sectional view of the swimming pool drain and sump assembly of FIG. 2B taken along cross-section line 2D-2D.
Figure 2E:
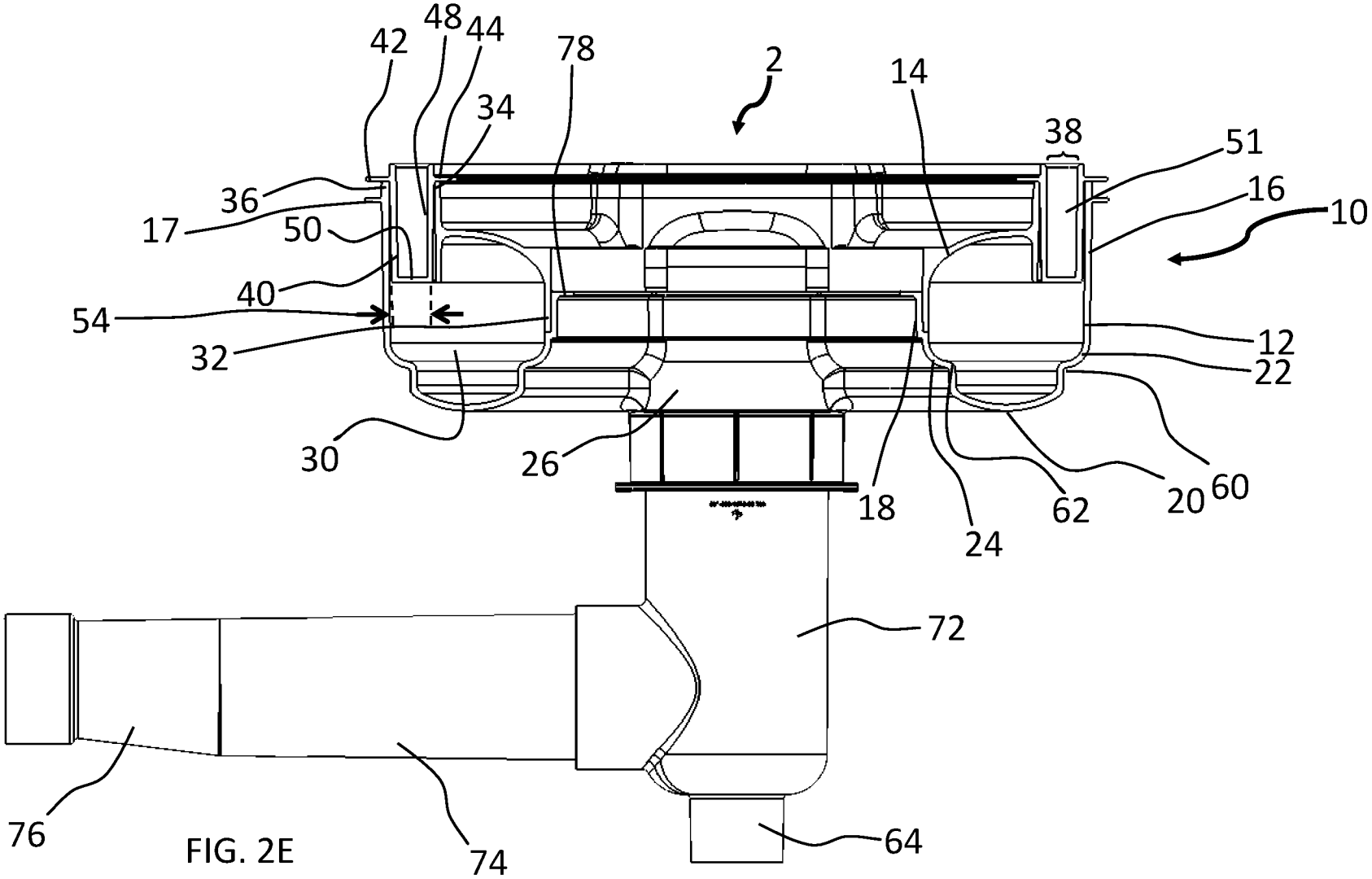
FIG. 2E is a cross-sectional view of the swimming pool drain and sump assembly of FIG. 2B taken along cross-section line 2E-2E.
Figure 2F:
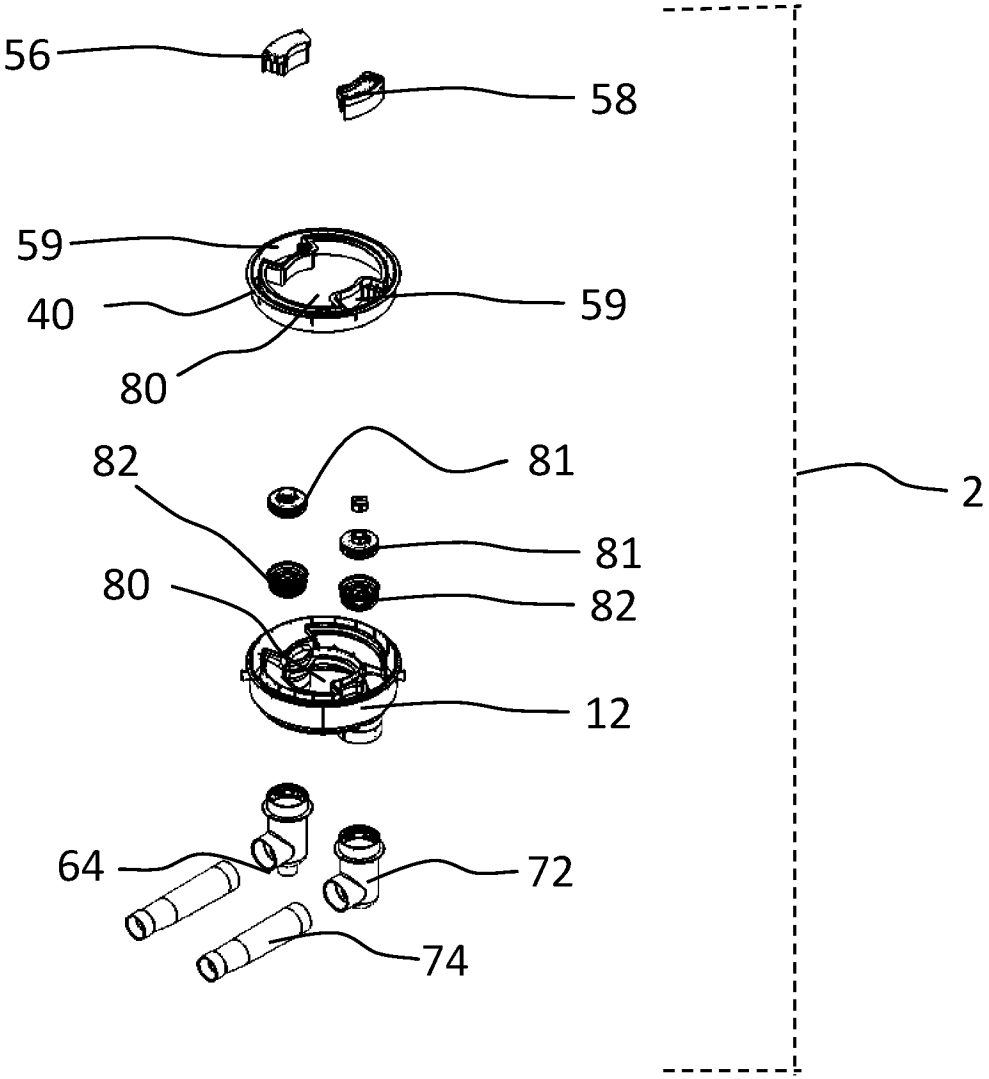
FIG. 2F is an exploded view of the swimming pool drain and sump assembly of FIG. 2A.
Figure 2G:
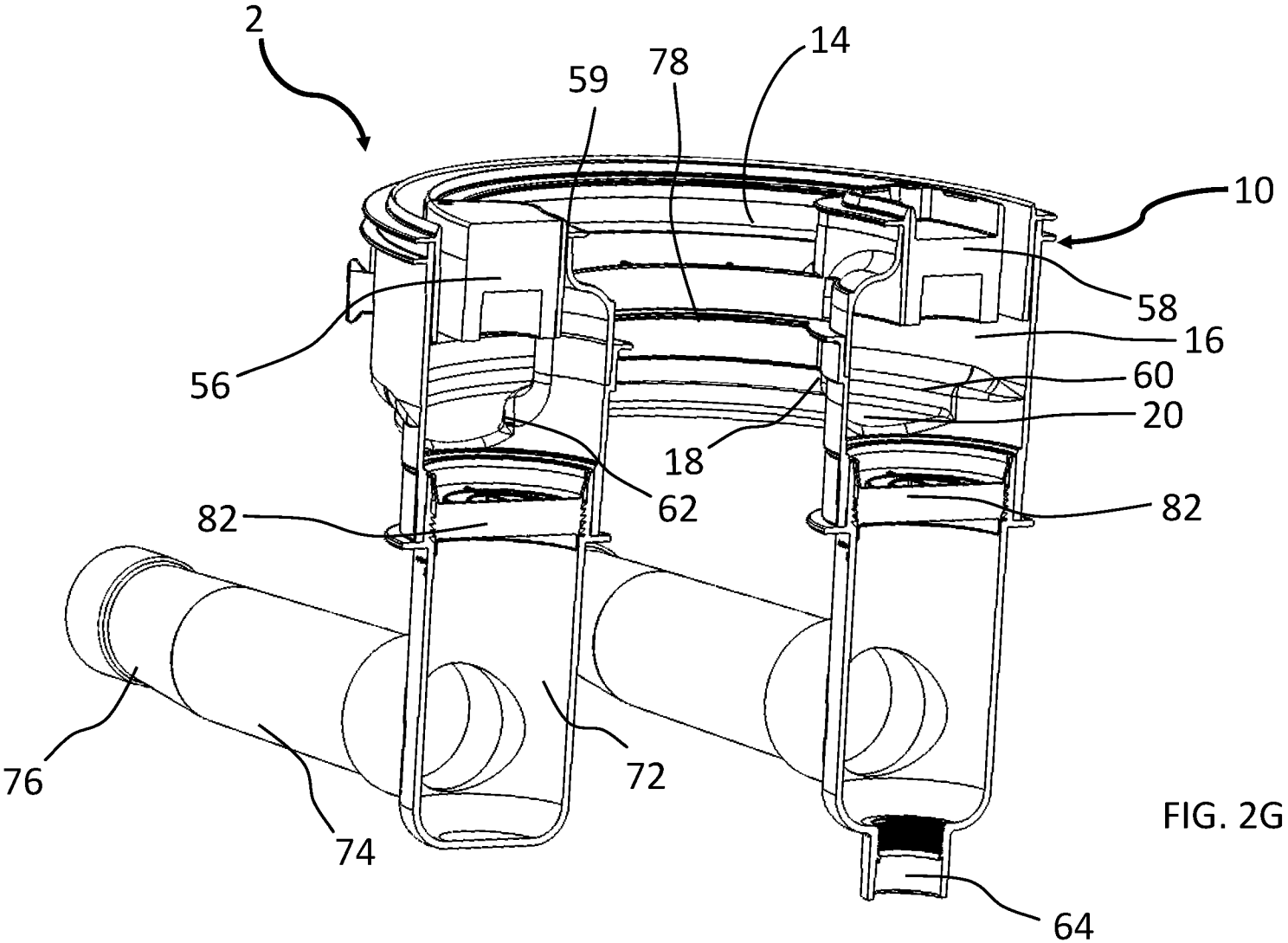
FIG. 2G is a cross-sectional view of the swimming pool drain and sump assembly of FIG. 2B taken along cross-section line 2D-2D with thread protectors installed.

FIG. 2B illustrates a first blockage tray insert 40 with a smaller blockage wall 50 to allow a higher flow of water to enter the drain. FIG. 3B illustrates a second blockage tray insert with a larger blockage wall 50 to allow a lower flow of water to enter the drain. Those of ordinary skill in the art will understand the fluid flow dynamics and requirements for a particular pool system and will understand from the teachings herein what size of blockage wall 50 to use for a particular swimming pool. By having blockages and openings only in certain areas of the blockage tray insert 40, the installer can control velocities for reducing hair entrapment and for managing debris collection. Different configurations of blockage trays are each configured to regulate flow into the drain to improve safety and debris removal rate for a particular application flow rate for the drain as installed. The ability to select an appropriate blockage tray insert for a particular application provides significant adaptability at a lower cost.

In the particular embodiments shown, the access port covers 56, 58 are seated on the blockage tray insert 40 in an access port 59 that extends both through the blockage tray insert 40 and through an edge of the sump cover 14. However, the sump port cover 14 may be configured to support the access port covers 56 with help from the blockage tray insert 40 or without any structural help. As illustrated in FIGS. 2D and 3C, in particular embodiments, the at least one access port covers 56, 58 may form a portion of a side wall of the annular, continuous, uninterrupted, single orifice drain entrance channel 38, and part of the blockage tray insert channel 51 where a blockage tray insert 40 is used. By creating an access port cover 56, 58 that does not bridge the entrance channel 38 to the drain 2, 3, fluid does not flow through the access port cover 56, 58 and the single orifice entrance channel 38 is never bridged to make an entanglement point for hair, clothing or other item that may be drawn into the opening. In a particular embodiment, the access port cover extends adjacent to the drain entrance channel 38 around the annular sump. In particular embodiments, the access port covers 56, 58 may be formed as part of the blockage tray insert 40 so that they may be removed and added to the entrance channel 38 as one piece in a donut shape.

In particular embodiments, a hydrostatic safety port 64 is included in the bottom wall 20 of the sump base 13 (FIG. 3C) or is otherwise included in the bottom wall 20 of the sump base 13 by its inclusion in the drain pipe 72 (FIG. 2D). The hydrostatic safety port 64 may include a port bellows 66 and check valve 68 (FIG. 3F), or a hydrostatic safety port plug. As illustrated in FIG. 3F, an optional port bellows 66 and check valve 68 may be included. In the embodiment of FIG. 3F, a hydrostatic safety port 64 is located opposite and farthest away from the drain outlet port 26 to minimize the draw on the check valve 68. The hydrostatic safety port 64 may be further isolated by use of a shielded channel 88 connecting the port to the exterior of the drain's sump area, such as through an access port cover 58. In the embodiment of FIG. 3F, this is done with a hydrostatic port bellows 66 that sits around the check valve and isolates the check valve 68 and hydrostatic safety port 64 from the sump channel 30 by creating a channel 88 from the hydrostatic safety port 64 up through the access port cover 58. The flexible port bellows 66 can expand and contract as needed without completely collapsing, relying on the vent 85 that extends through the access port cover 58. In embodiments like that shown in FIG. 2G, the hydrostatic safety port 64 may be located at the bottom of one or both of the drain outlet ports 26, 28.

The use of outwardly extending flanges 17, 42, 44 on the outer wall 16, the outer edge wall 46 and the inner edge wall 48 provides stability for the drain and helps to secure its position within the plaster 6 and/or aggregate 4. With the outer wall flange 17 extending outward of the outer wall 16, the concrete 8 and/or aggregate 4 will encase the outer wall flange 17 and flanges 42 and 44 (FIGS. 2E, 3D) to more securely position the drain in the floor of the swimming pool. Furthermore, by providing the single orifice drain entrance channel 38 and a separate blockage tray insert 40, the top of the blockage tray insert 40 can be positioned at an angle level with the ground-surface of the pool regardless of whether the top edge 36 of the outer wall 16 and the upper edge 34 of the inner wall 14 are angled level with that same surface. Because the blockage tray insert 40 is separate from the drain entrance channel 38, its angle in relation to the pool surface can be adjusted to be level as the installer is installing the plaster 6 and/or aggregate 4 so that the drain can appear to be level every time. In conventional swimming pool drain installations, because the installer is limited by the physical plumbing pipes and their locations, and the extensions from the drain assembly, it is sometimes difficult to mount the drain perfectly level with the as-of-yet-uninstalled pool structure forming the future inside surface of the pool, whether it be concrete, plaster, aggregate, vinyl, fiberglass or other pool finish. By including the blockage tray insert 40 that also acts as an adjustable guide to the entrance channel 38 of the drain assembly 2, 3, the installer can have a level-looking drain installation every time. In particular embodiments, the leveling ring portion of the blockage tray insert 40 is configured with at least 2½ inches of total vertical height below the flanges and can tip up to 1 inch off of level and still maintain connection with the drain entrance channel 38.

At least one access port cover 56, 58 is positioned within at least one access port 59 between the top edge 36 of the outer wall 16 and the upper edge 34 of the sump cover 14. Ideally, the at least one access port 59 and its respective at least one access port cover 56, 58 is positioned directly above the at least one drain outlet port 26. By providing the access ports 59 and covers 56, 58 directly above the drain outlet ports 26, the drain outlet ports 26 are more easily accessed to clean the drain and provide maintenance. Furthermore, access ports generally are minimized in size to keep their profile stronger and less visible. By positioning the access port covers 56, 58 immediately adjacent to and in communication with the drain entrance channel 38, the drain entrance channel 38 space can also be used for access while minimizing the size of the access port covers 56, 58. The access ports 59 and covers' 56, 58 size is optimized so that the outlet seal plug 81 fits thru as small a place as possible using the access ports 59 and drain entrance channel 38 to full advantage.

Figure 3A:
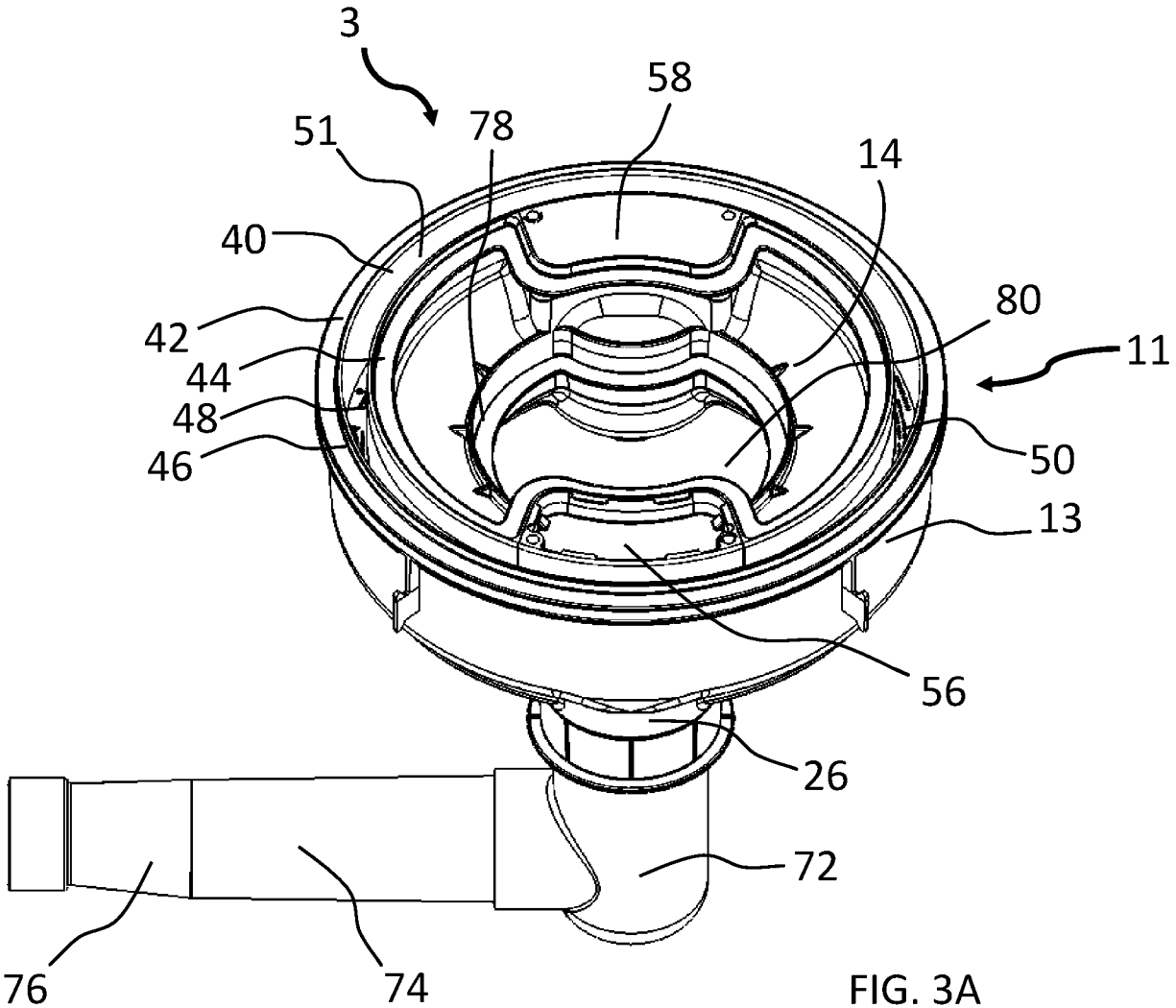
FIG. 3A is a perspective view of a swimming pool drain and sump assembly with one drain pipes.
Figure 3B:
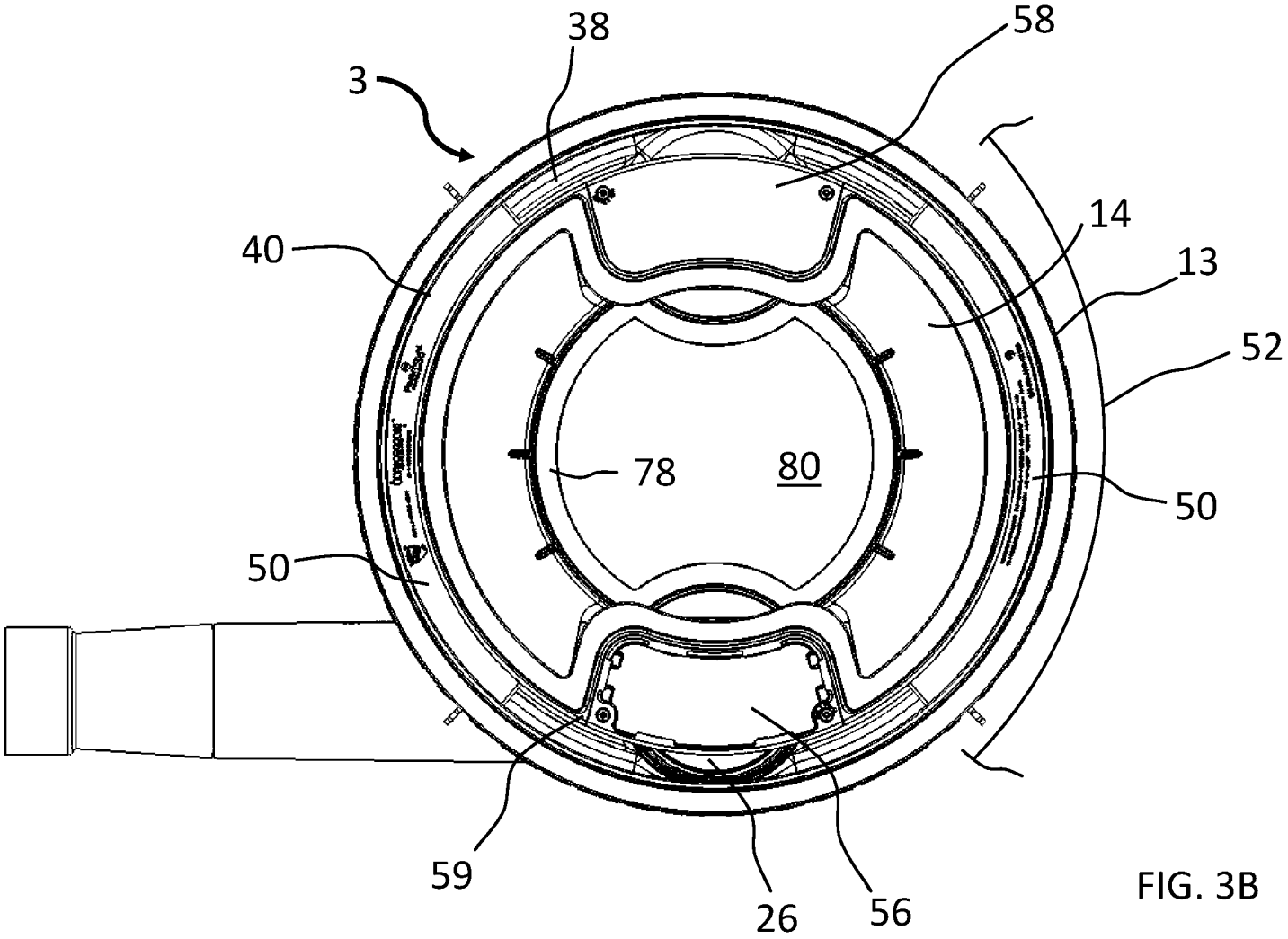
FIG. 3B is a top view of the swimming pool drain and sump assembly of FIG. 3A.
Figure 3C:
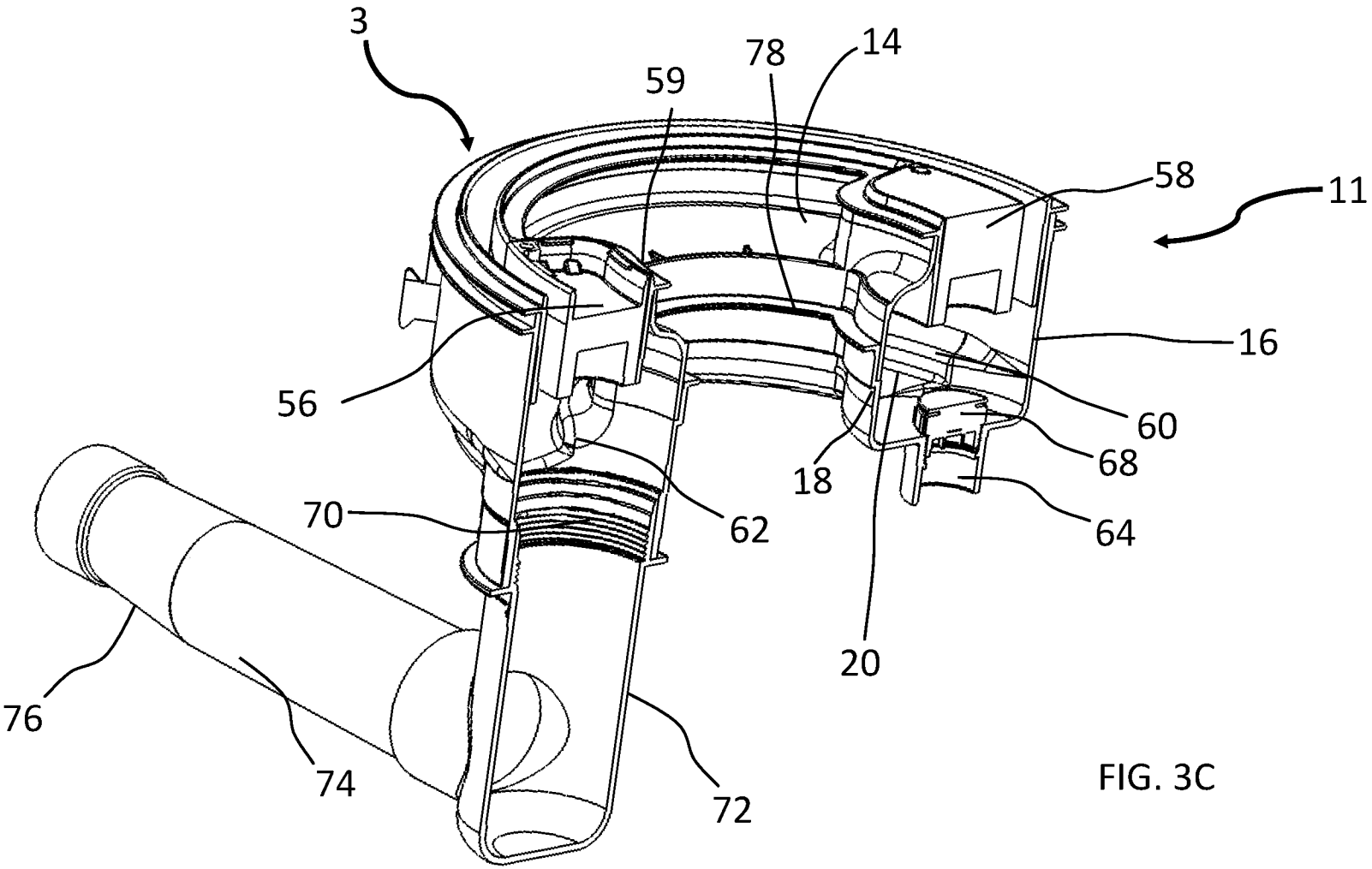
FIG. 3C is a cross-sectional view of the swimming pool drain and sump assembly of FIG. 3B taken along cross-section line 3C-3C.
Figure 3D:
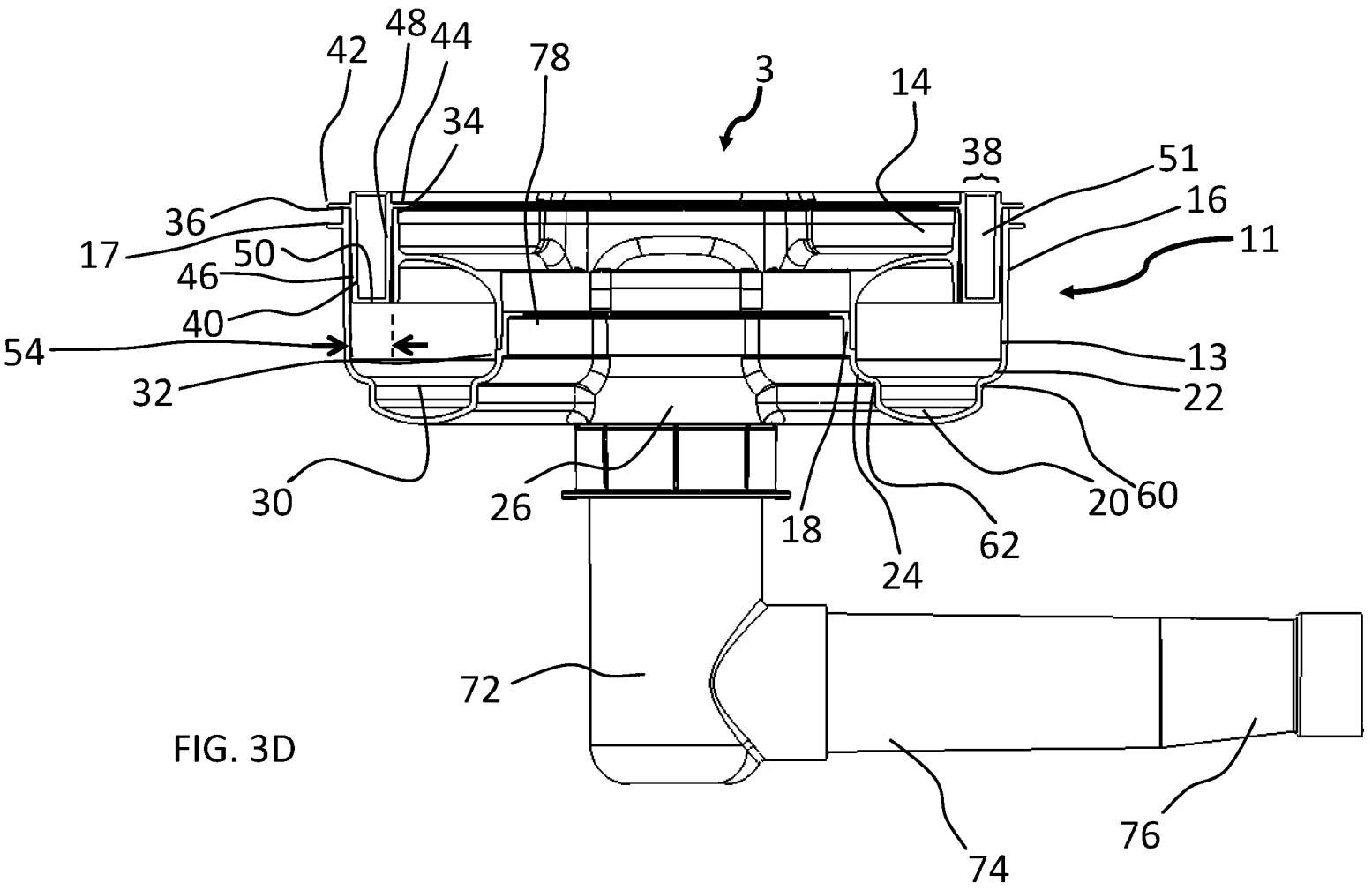
FIG. 3D is a cross-sectional view of the swimming pool drain and sump assembly of FIG. 3B taken along cross-section line 3D-3D.
Figure 3E:
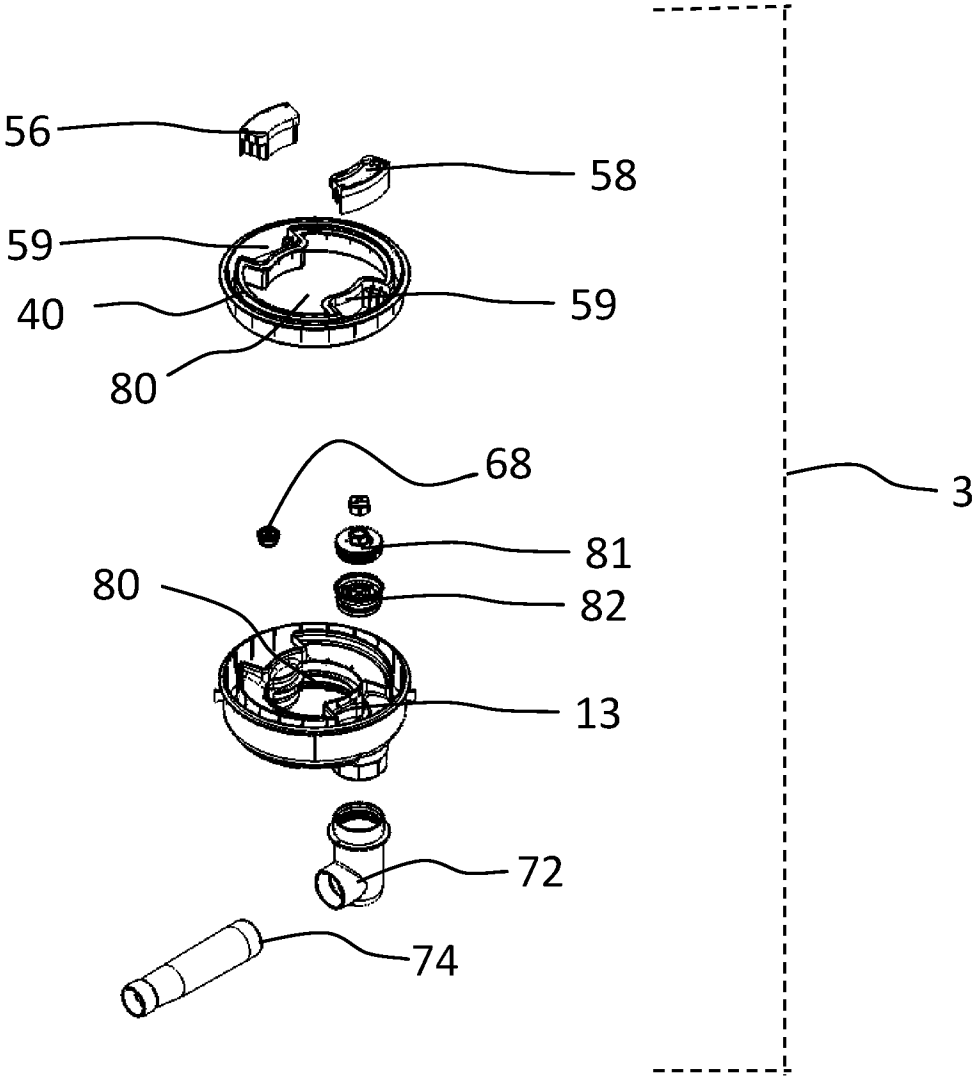
FIG. 3E is an exploded view of the swimming pool drain and sump assembly of FIG. 3A.
Figure 3F:
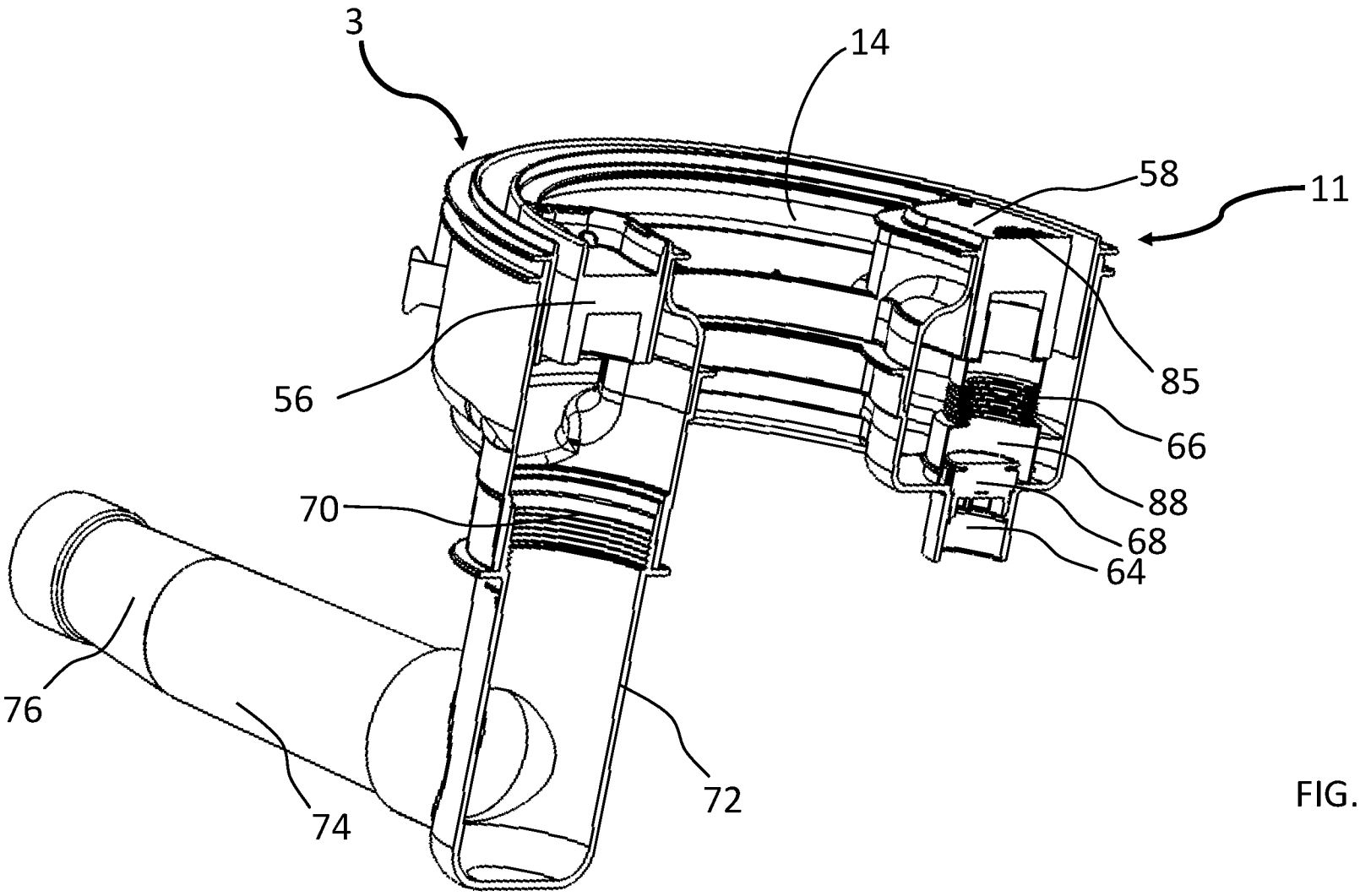
FIG. 3F is a cross-sectional view of the swimming pool drain and sump assembly of FIG. 3B taken along cross-section line 3C-3C with a port bellows and check valve installed.

FIGS. 2F and 3E illustrate exploded views of the swimming pool drain and sump assemblies 2, 3 of FIGS. 2A and 3A, respectively. As illustrated, each shows access port covers 56, 58, a blockage tray insert 40 with access ports 59 extending through the blockage tray inserts 40, drain seal plugs 81, thread protectors 82, a sump cover 14 with access ports 59 extending through opposing edges of the sump cover 14 and a continuous, unimpeded passageway 80 through the center of the housing, a sump base 12, 13 with an unimpeded passageway 80 through the center of the housing, one or more vertically descending portions 72 and horizontally extending portions 74, and a hydrostatic safety port 64. By including a complete passageway 80 through the center of the drain assembly 2, 3, concrete slurry can entirely fill the opening without the need to fill smaller openings around intermediary pipes and support structures. By providing a center passageway 80 that is completely unblocked, the concrete is more easily packed in the center and around the entire annular sump. The open center passageway 80 allows for ease of filling the center of the drain with the pool wall construction material whether it be concrete and plaster or other aggregate finish. This is advantageous to hide the drain and make it virtually disappear in the pool floor or wall while at the same time strengthening and not weakening the pool structure. Other conventional drains make application of the pool aggregate difficult and weaken the integrity of the wall by leaving voids and by adding stress crack points in the wall structure. For example, in other conventional approaches, the center of the drain includes passages, like spokes of a wheel, that lead to a centrally located hub and exit port. This area is filled with concrete, but the passages block the free flow of concrete and can cause voids and stress points in the concrete that often show through the final finish and cause leaks in the pool shell.

Additionally, by providing a drain center passageway 80 that is entirely open, the passageway 80 provides additional options for pool installers to place a slurry pump in the center of the pool drain during the final finish aggregate application. Conventionally, this piece of equipment is difficult to place because it needs to be kept off of the pool floor during final finish aggregate application. Once the aggregate is applied, the remaining opening in the drain center passageway 80 can be filled with matching final finish aggregate at the end of the application process. This final finish would then be less likely to crack or craze because it is applied directly to the aggregate pool wall and not to a plastic cover of the drain. Many conventional approaches fill the center of the pool drain with aggregate by filling a top portion of a drain lid with aggregate to match. But that aggregate is prone to cracking because it is thin and coupled to a flexible surface. Conventional approaches that use a very large sump further make it difficult to get concrete below the sump to provide sufficiently good structure and no leak paths for the pool.

Figures 4A, 4B, 4C:
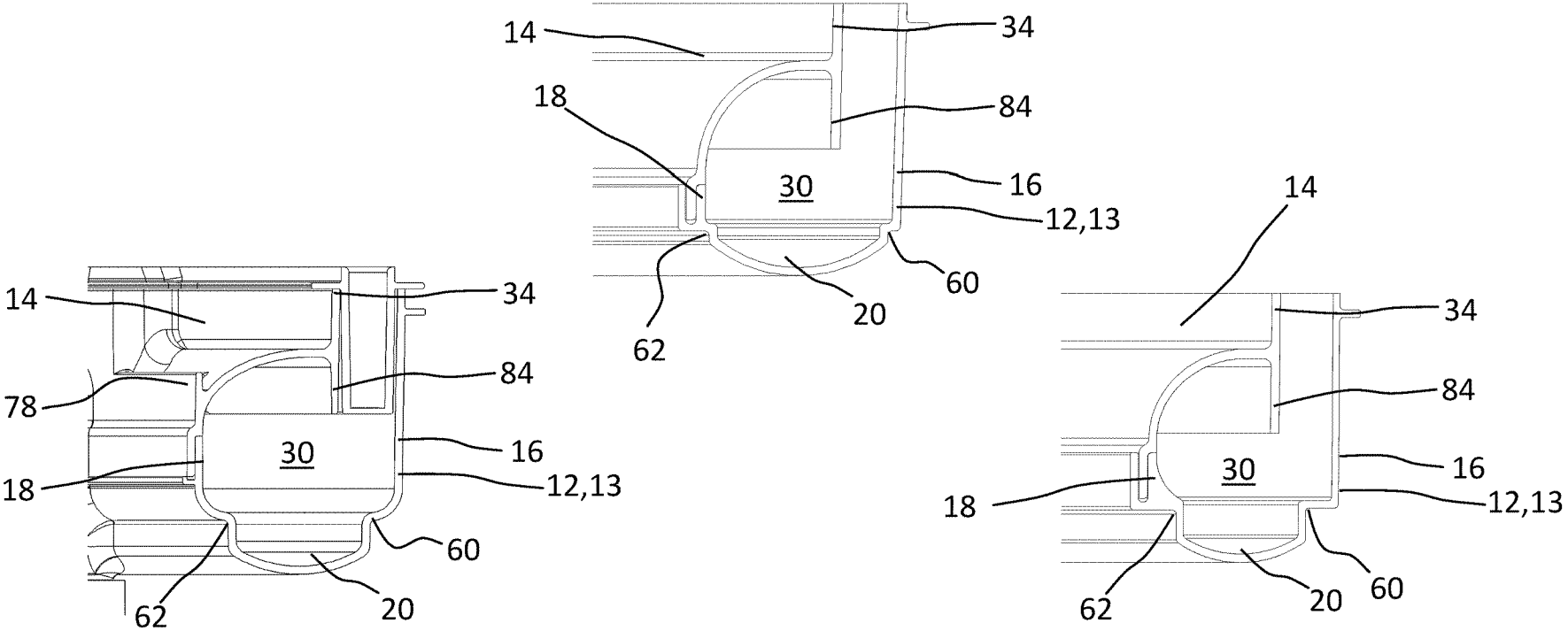
FIG. 4A is a close-up cross-sectional view of a sump channel similar to that shown in FIG. 2E, the sump channel having a first cross-sectional shape.
FIG. 4B is a close-up cross-sectional view of a sump channel similar to that shown in FIG. 2E, the sump channel having a second cross-sectional shape.
FIG. 4C is a close-up cross-sectional view of a sump channel similar to that shown in FIG. 2E, the sump channel having a third cross-sectional shape.
Figure 4F:
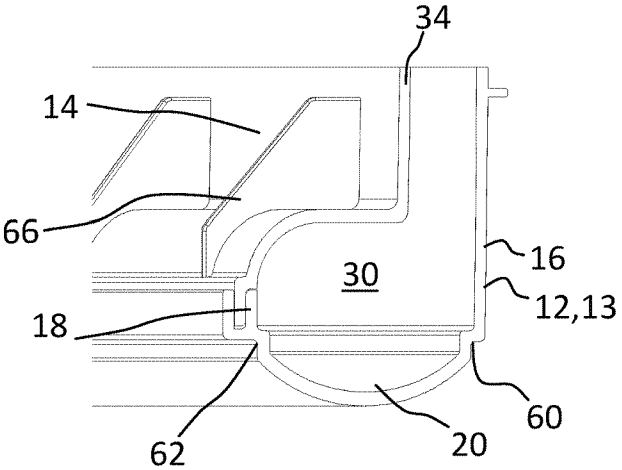
FIG. 4F is a close-up cross-sectional view of a sump channel similar to that shown in FIG. 2E, the sump channel having a sixth cross-sectional shape.
Figure 4E:
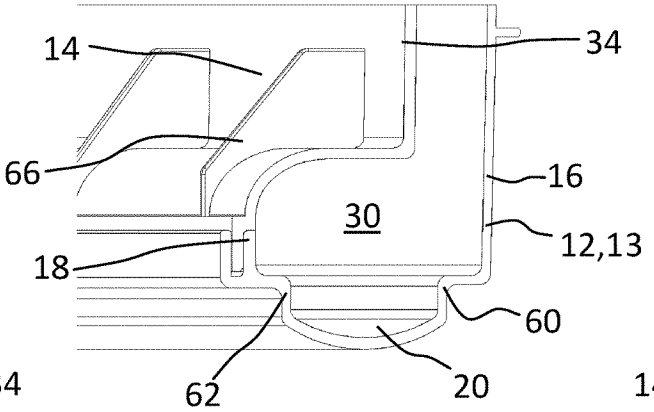
FIG. 4E is a close-up cross-sectional view of a sump channel similar to that shown in FIG. 2E, the sump channel having a fifth cross-sectional shape.
Figure 4D:
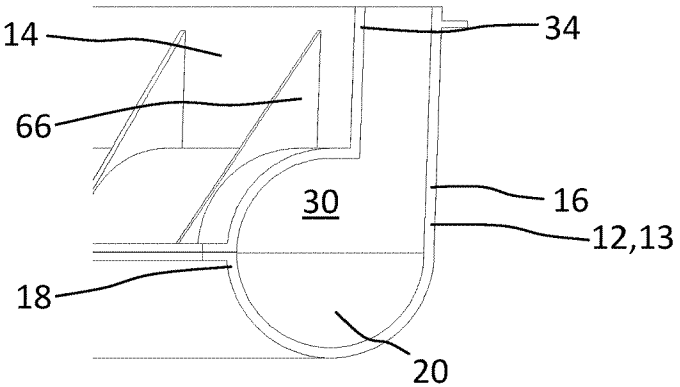
FIG. 4D is a close-up cross-sectional view of a sump channel similar to that shown in FIG. 2E, the sump channel having a fourth cross-sectional shape.

With specific reference to FIGS. 4A-4F, close-up cross-sections of various embodiments of shapes for the sump channel 30. The first three embodiments (FIGS. 4A-4C) illustrate the sump base 12, 13, the sump cover 14, with the sump channel 30 running between them, and the bottom wall 20. Between the bottom wall 20 and the respective side walls 16, 18 (FIGS. 2E, 3D), a step 60, 62 is included. The step 60, 62 provides additional structural strength to the sump channel 30 without interrupting the sump channel 30 water flow through it. In FIGS. 4A and 4C, the steps are larger than in FIG. 4B. Additionally, in FIGS. 4A-4C, a sump cover extension wall 84 extends downward from the upper edge 34 of the sump cover 14. FIG. 4D shows an example without steps. The sump cover extension wall 84 provides additional structural strength to the sump and drain assembly. In embodiments where a sump cover extension wall 84 is not used (e.g. FIGS. 4D-4F), structural support fins 66 may be included on the outside of the sump cover 14 between the upper edge 34 and the lower edge 32. In particular embodiments, a water stop 78 may be included on an inner wall of the drain and sump assembly 2, 3, that extends away from the sump base 12, 13, such as extending upward (FIG. 4A) or extending radially inward (FIGS. 2A-2E and 3A-3D).

Figure 5:
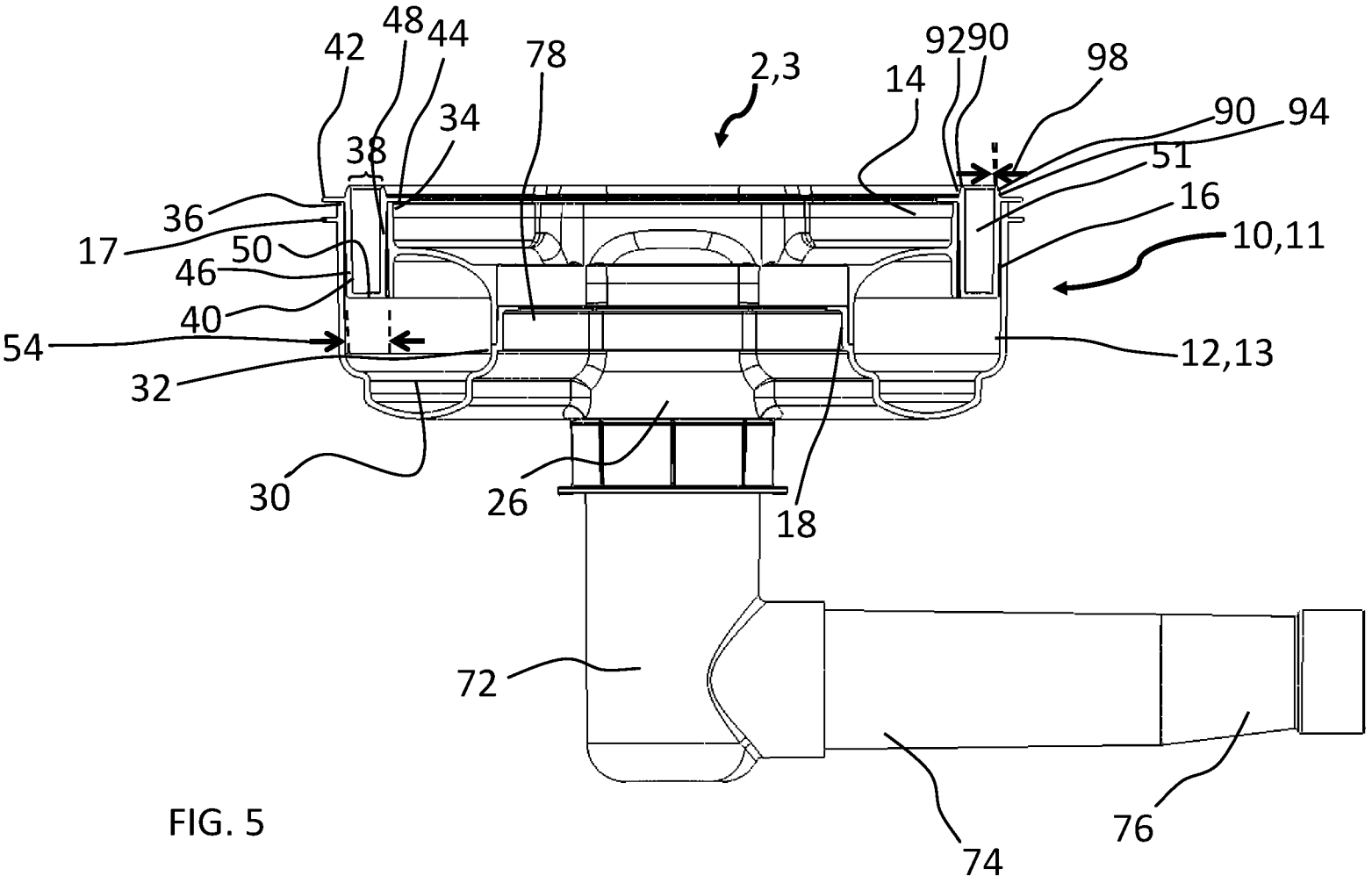
FIG. 5 is a cross-sectional view of a swimming pool drain and sump assembly similar to that of FIG. 3D, illustrating a blockage tray insert with a tapered leading edge.

FIG. 5 illustrates a cross-sectional view of a swimming pool drain and sump assembly like that of FIG. 3D, but with a modification to the blockage tray insert 40. The previous descriptions associated with all embodiments of a swimming pool drain and sump assembly apply equally to this embodiment. The blockage tray insert 40 of FIG. 5 includes a tapered leading edge 90 with tapered outer sides 92, 94 of the respective leading edges 90. A similar principle was included in the leading edges of the housing of swimming pool floor cleaning nozzles in U.S. patent application Ser. No. 16/181,217 to Goettl, filed Nov. 5, 2018, titled "In-Floor Swimming Pool Nozzle Housing with Outer Beveled Edge," the disclosure of which is hereby incorporated herein by this reference. As applied to the blockage tray insert 40 of FIG. 5, unlike a conventional leading edge of a drain housing, the leading edge 90 of the blockage tray insert 40 is formed with a tapered end, the tapered outer sides 92, 94 of the outer side wall 46 and inner side wall 48 of the blockage tray insert 40 having a thickness 98 that is narrower at the leading edge 90 than it is at other points along the wall as the wall extends toward and into the entrance channel 38. In particular embodiments, the thickness 98 at the tapered end is only 1/32" or 1/16" or less for a wall that has a standard wall thickness of 1/8".

It will be understood that implementations are not limited to the specific components disclosed herein, as virtually any components consistent with the intended operation of a method and/or system implementation for swimming pool drain assemblies may be utilized. Accordingly, for example, although particular embodiments and material types may be disclosed, such components may comprise any shape, size, style, type, model, version, class, grade, measurement, concentration, material, weight, quantity, and/or the like consistent with the intended operation of a method and/or system implementation may be used. In places where the description above refers to particular embodiments of swimming pool drain assemblies, features and components, it should be readily apparent that a number of modifications may be made without departing from the spirit thereof and that these implementations may be applied to other swimming pool drain assemblies. In particular, the principles and features of the sump and drain embodiments disclosed herein may be applied to other shapes such as toroidal and non-contiguous shapes that are round and even straight. A structure with only one adhesion joint between the bottom and upper halves of the sump may also be used to form sumps of other shapes.

The invention claimed is:

1. A swimming pool drain and sump assembly for an in-floor swimming pool drain, the assembly comprising:

a two-piece toroidal drain housing consisting essentially of:

a lower section forming a sump base having an annular outer wall, an annular inner wall, and an annular bottom wall joining the annular inner wall and the annular outer wall along bottoms of each of the annular inner wall and the annular outer wall, the annular bottom wall comprising at least one drain outlet port extending through the annular bottom wall, the lower section forming a continuous annular channel that loops back upon itself;

an upper section forming a sump cover supported upon the sump base only along the annular inner wall, the sump cover extending in a cantilevered fashion over the sump base from a lower edge of the sump cover to an upper edge of the sump cover, the sump cover engaging the annular inner wall of the sump base;

wherein the lower section and the upper section forming an annular, continuous, uninterrupted, single orifice drain entrance channel between a top edge of the outer wall and the upper edge of the sump cover;

a continuous, one-piece blockage tray insert adjustably positioned within the drain entrance channel and configured to allow an angle of the blockage tray insert to be adjusted separate from the top edge of the annular outer wall of the sump base, the blockage tray insert comprising an outer edge flange extending outward of the top edge of the annular outer wall of the sump base, and an inner edge flange extending inward of the upper edge of the sump cover, the blockage tray insert comprising an outer edge wall extending into the drain entrance channel from the outer edge flange and an inner edge wall extending into the drain entrance channel from the inner edge flange, and at least one blockage wall extends between the outer edge wall and the inner edge wall, the at least one blockage wall oriented such that a length of the blockage wall extending along an annular length within the drain entrance channel is longer than its width extending from the outer edge wall to the inner edge wall; and at least one access port cover positioned between the top edge of the annular outer wall and the upper edge of the sump cover, the at least one access port cover positioned directly above the at least one drain outlet port within at least one access port that is a continuous opening with the annular, continuous, uninterrupted, single orifice drain entrance channel.

2. The swimming pool drain and sump assembly of claim 1, wherein the sump base comprises a cross-sectional shape having an outwardly extending, rounded bottom wall with an inwardly extending first step in the bottom wall between the bottom wall and the annular outer wall, and an inwardly extending second step between the bottom wall and the annular inner wall.

3. The swimming pool drain and sump assembly of claim 1, further comprising structural support fins formed as part of the sump cover between the upper edge and the lower edge of the sump cover.

4. The swimming pool drain and sump assembly of claim 1, the blockage tray insert further comprising an opening sized to receive the at least one access port cover between the outer edge flange and the inner edge flange, wherein a wall of the at least one access port cover forms a portion of a side wall of the annular, continuous, uninterrupted, single orifice drain entrance channel.

5. The swimming pool drain and sump assembly of claim 1, wherein the at least one drain outlet port extending through the annular bottom wall comprises two drain outlet ports extending through the annular bottom wall, the two drain outlet ports positioned annularly opposite each other on the annular bottom wall.

6. The swimming pool drain and sump assembly of claim 1, further comprising a hydrostatic safety port coupled to the annular bottom wall, the hydrostatic safety port coupled to the annular bottom wall through an opening positioned annularly opposite the at least one drain outlet port extending through the annular bottom wall.

7. The swimming pool drain and sump assembly of claim 6, wherein the at least one drain outlet port extending through the annular bottom wall comprises two drain outlet ports extending through the annular bottom wall, the two drain outlet ports positioned annularly opposite each other on the annular bottom wall, wherein the hydrostatic safety port is coupled to the annular bottom wall at a bottom of a drain pipe coupled to one of the two drain outlet ports.

8. The swimming pool drain and sump assembly of claim 6, further comprising a hydrostatic port bellows surrounding the hydrostatic safety port and extending between the hydrostatic safety port and a first of the at least one access port covers, the hydrostatic port bellows isolating the hydrostatic safety port from drain suction pressure within the sump assembly.

9. The swimming pool drain and sump assembly of claim 1, wherein a center area of the drain and sump assembly is open providing a continuous, unimpeded passageway through a toroidal center of the two-piece toroidal drain housing.

10. The swimming pool drain and sump assembly of claim 1, wherein the sump cover further comprises a water stop extending away from the sump base between the lower edge of the sump cover and the upper edge of the sump cover.

11. A swimming pool drain and sump assembly for an in-floor swimming pool drain, the assembly comprising:

a toroidal drain housing comprising:

a bottom piece forming a sump base having an annular outer wall, an annular inner wall, and an annular bottom wall joining the annular inner wall and the annular outer wall along bottoms of each of the annular inner wall and the annular outer wall, the annular bottom wall comprising at least one drain outlet port extending through the annular bottom wall, the bottom piece forming an annular channel that loops back upon itself; and a top piece forming a sump cover with a lower edge engaging the annular inner wall of the sump base, the sump cover supported upon and extending over the sump base;

wherein the bottom piece and the top piece form a continuous, annular, single orifice drain entrance channel between a top edge of the annular outer wall and the upper edge of the top piece.

12. The swimming pool drain and sump assembly of claim 11, further comprising a blockage tray insert positioned within the drain entrance channel, the blockage tray insert comprising an outer edge flange extending outward of the top edge of the outer wall of the sump base, an inner edge flange extending inward of the upper edge of the top piece, an outer edge wall extending into the drain entrance channel from the outer edge flange, and an inner edge wall extending into the drain entrance channel from the inner edge flange.

13. The swimming pool drain and sump assembly of claim 12, wherein the blockage tray insert comprises at least one blockage wall that extends between the outer edge wall and the inner edge wall that is oriented such that a length of the blockage wall extending along an annular length within the drain entrance channel is longer than its width extending from the outer edge wall to the inner edge wall.

14. The swimming pool drain and sump assembly of claim 11, further comprising at least one access port cover positioned between the top edge of the annular outer wall and the upper edge of the top piece, the at least one access port cover positioned directly above the at least one drain outlet port, wherein the at least one access port cover is positioned within at least one access port that is a continuous opening with the continuous, annular, single orifice drain entrance channel and a wall of the at least one access port cover forms a portion of a side wall of the continuous, annular, single orifice drain entrance channel.

15. The swimming pool drain and sump assembly of claim 11, wherein the at least one drain outlet port extending through the annular bottom wall comprises two drain outlet ports extending through the annular bottom wall, the two drain outlet ports positioned opposite each other on the annular bottom wall.

16. The swimming pool drain and sump assembly of claim 11, further comprising a hydrostatic safety port coupled to the annular bottom wall through an opening positioned annularly opposite the at least one drain outlet port extending through the annular bottom wall.

17. A swimming pool drain and sump assembly for an in-floor swimming pool drain, the assembly comprising a two-piece drain housing consisting essentially of:

a bottom piece forming a sump base having an outer wall, an inner wall, and an annular bottom wall joining the inner wall and the outer wall, the annular bottom wall comprising at least one drain outlet port extending through the annular bottom wall, the bottom piece forming a channel; and a top piece forming a sump cover with a lower edge engaging the inner wall of the sump base, the sump cover supported upon and extending over the sump base;

wherein the bottom piece and the top piece form a continuous, annular, single orifice drain entrance channel between a top edge of the outer wall and an upper edge of the top piece.

18. The swimming pool drain and sump assembly of claim 17, further comprising at least one access port cover positioned between the top edge of the outer wall and the upper edge of the top piece, the at least one access port cover positioned directly above the at least one drain outlet port, wherein the at least one access port cover is positioned within at least one access port that is a continuous opening with the continuous, annular, uninterrupted, single orifice drain entrance channel.

19. The swimming pool drain and sump assembly of claim 17, further comprising a blockage tray insert positioned within the drain entrance channel, the blockage tray insert comprising an outer edge flange extending outward of the top edge of the outer wall of the sump base, an inner edge flange extending inward of the upper edge of the top piece, an outer edge wall extending into the drain entrance channel from the outer edge flange, and an inner edge wall extending into the drain entrance channel from the inner edge flange.

20. The swimming pool drain and sump assembly of claim 17, further comprising a hydrostatic safety port coupled to the annular bottom wall through an opening positioned annularly opposite the at least one drain outlet port extending through the annular bottom wall.

21. The swimming pool drain and sump assembly of claim 20, wherein the at least one drain outlet port extending through the annular bottom wall comprises two drain outlet ports extending through the annular bottom wall, the two drain outlet ports positioned annularly opposite each other on the annular bottom wall, wherein the hydrostatic safety port is coupled to the annular bottom wall at a bottom of a drain pipe coupled to one of the two drain outlet ports.

* * * * *